US011099493B2

(12) United States Patent
Komiya et al.

(10) Patent No.: US 11,099,493 B2
(45) Date of Patent: Aug. 24, 2021

(54) TONER

(71) Applicant: CANON KABUSHIKI KAISHA, Tokyo (JP)

(72) Inventors: Yuta Komiya, Suntou-gun (JP); Daisuke Yoshiba, Suntou-gun (JP); Tomoya Nagaoka, Tokyo (JP); Kazuyuki Sato, Yokohama (JP); Tomohisa Sano, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/868,635

(22) Filed: May 7, 2020

(65) Prior Publication Data

US 2020/0363746 A1 Nov. 19, 2020

(30) Foreign Application Priority Data

May 14, 2019 (JP) ..... JP2019-091356

(51) Int. Cl.
*G03G 9/087* (2006.01)
*G03G 9/08* (2006.01)

(52) U.S. Cl.
CPC ..... *G03G 9/08711* (2013.01); *G03G 9/0819* (2013.01); *G03G 9/0823* (2013.01); *G03G 9/08755* (2013.01)

(58) Field of Classification Search
CPC ..... G03G 9/08755; G03G 9/08797
See application file for complete search history.

(56) References Cited

U.S. PATENT DOCUMENTS

| | | | |
|---|---|---|---|
| 7,123,862 | B2 | 10/2006 | Hasegawa et al. |
| 7,537,877 | B2 | 5/2009 | Yoshiba et al. |
| 7,544,455 | B2 | 6/2009 | Yoshiba et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,700,254 | B2 | 4/2010 | Moribe et al. |
| 7,740,998 | B2 | 6/2010 | Yamazaki et al. |
| 7,796,926 | B2 | 9/2010 | Matsuda et al. |
| 7,855,042 | B2 | 12/2010 | Kobori et al. |
| 7,923,190 | B2 | 4/2011 | Magome et al. |
| 7,935,467 | B2 | 5/2011 | Dojo et al. |
| 8,057,977 | B2 | 11/2011 | Moribe et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 9,097,998 | B2 | 8/2015 | Yamazaki |
| 9,128,400 | B2 | 9/2015 | Takahashi et al. |
| 9,152,065 | B2 | 10/2015 | Sano et al. |
| 9,201,323 | B2 | 12/2015 | Nishikawa et al. |
| 9,235,151 | B2 | 1/2016 | Tanaka et al. |
| 9,250,548 | B2 | 2/2016 | Nomura et al. |
| 9,261,804 | B2 | 2/2016 | Yamazaki et al. |
| 9,341,970 | B2 | 5/2016 | Yoshiba et al. |
| 9,377,708 | B2 | 6/2016 | Magome et al. |
| 9,470,996 | B2 | 10/2016 | Yamauchi et al. |
| 9,551,947 | B2 | 1/2017 | Hiroko et al. |
| 9,606,462 | B2 | 3/2017 | Nomura et al. |
| 9,804,514 | B2 | 10/2017 | Suzumura et al. |
| 9,804,519 | B2 | 10/2017 | Suzumura et al. |
| 9,829,818 | B2 | 11/2017 | Yoshiba et al. |
| 9,841,692 | B2 | 12/2017 | Hasegawa et al. |
| 9,927,728 | B2 | 3/2018 | Arimura et al. |
| 9,946,179 | B2 | 4/2018 | Arimura et al. |
| 9,946,181 | B2 | 4/2018 | Hasegawa et al. |
| 9,964,874 | B2 | 5/2018 | Suzumura et al. |
| 9,964,881 | B2 | 5/2018 | Ikejiri et al. |
| 9,971,262 | B2 | 5/2018 | Hasegawa et al. |
| 9,971,263 | B2 | 5/2018 | Fukudome et al. |
| 9,971,264 | B2 | 5/2018 | Sano et al. |
| 10,012,923 | B2 | 7/2018 | Sano et al. |
| 10,101,683 | B2 | 10/2018 | Nishikawa et al. |

(Continued)

FOREIGN PATENT DOCUMENTS

| | | |
|---|---|---|
| JP | 2011-149986 | 8/2011 |
| JP | 2015-169770 | 9/2015 |

OTHER PUBLICATIONS

U.S. Appl. No. 16/819,736, Kazuyuki Sato, filed Mar. 16, 2020.
U.S. Appl. No. 16/880,017, Tomoya Nagaoka, filed May 21, 2020.
U.S. Appl. No. 16/910,301, Daiuke Yoshiba, filed Jun. 24, 2020.
Fedors, "A Method for Estimating Both the Solubility Parameters and Molar Volumes of Liquids", Poly. Eng. Sci., vol. 14, No. 2 (1974) 147-54.

*Primary Examiner* — Peter L Vajda
(74) *Attorney, Agent, or Firm* — Venable LLP

(57) ABSTRACT

A toner comprising a toner particle containing a resin component, wherein the resin component contains an amorphous polyester and a crystalline polyester, and in depth profile measurement of secondary ions on the toner particle surface by TOF-SIMS, given Ia(t) as the intensity of secondary ions derived from the amorphous polyester, Ic(t) as the intensity of secondary ions derived from the crystalline polyester, and I(t) as the total detected intensity of secondary ions derived from resin contained in the toner particle at a depth of t (nm) from the toner particle surface, the following formulae are satisfied within the range of $0 \leq t \leq 10$:

$$Ia(t) > Ic(t) > 0.0000$$

$$(Ia(t) + Ic(t))/I(t) \geq 0.80$$

and there is only one point of intersection between the depth profile curve of Ia(t) and Ic(t) within the range of $10 \leq t \leq 30$.

15 Claims, No Drawings

(56) References Cited

U.S. PATENT DOCUMENTS

| | | | | |
|---|---|---|---|---|
| 10,151,990 | B2 | 12/2018 | Suzuki et al. | |
| 10,228,627 | B2 | 3/2019 | Nagashima et al. | |
| 10,289,016 | B2 | 5/2019 | Fukudome et al. | |
| 10,295,920 | B2 | 5/2019 | Nishikawa et al. | |
| 10,295,921 | B2 | 5/2019 | Ohmori et al. | |
| 10,303,075 | B2 | 5/2019 | Tanaka et al. | |
| 10,310,397 | B2 | 6/2019 | Sano et al. | |
| 10,545,420 | B2 | 1/2020 | Kinumatsu et al. | |
| 10,578,990 | B2 | 3/2020 | Tsuda et al. | |
| 10,698,327 | B2 | 6/2020 | Nagashima et al. | |
| 2005/0209364 | A1 | 9/2005 | Yamagishi et al. | |
| 2006/0121379 | A1 | 6/2006 | Dojo et al. | |
| 2009/0197192 | A1 | 8/2009 | Hiroko et al. | |
| 2013/0252167 | A1 | 9/2013 | Moribe et al. | |
| 2014/0004460 | A1 | 1/2014 | Yoshiba et al. | |
| 2015/0220013 | A1 | 8/2015 | Nishikawa et al. | |
| 2016/0139522 | A1 | 5/2016 | Yoshiba et al. | |
| 2016/0161874 | A1 | 6/2016 | Yamazaki et al. | |
| 2016/0363877 | A1* | 12/2016 | Hama ..... | G03G 9/08755 |
| 2016/0378003 | A1 | 12/2016 | Arimura et al. | |
| 2019/0041762 | A1 | 2/2019 | Yoshiba et al. | |
| 2019/0384194 | A1 | 12/2019 | Yoshiba et al. | |
| 2020/0081361 | A1 | 3/2020 | Yoshiba et al. | |
| 2020/0166861 | A1 | 5/2020 | Uratani et al. | |

* cited by examiner

TONER

BACKGROUND OF THE INVENTION

Field of the Invention

The present invention relates to a toner for use in image-forming methods such as electrophotographic methods.

Description of the Related Art

Image-forming devices such as copiers and printers have become smaller and more energy efficient in recent years. In response to this, there is increased need for toners with excellent low temperature fixability to allow fixing at lower temperatures.

One method for achieving low temperature fixability is to lower the softening temperature of the binder resin in the toner. If the binder resin has a low softening temperature, however, the heat-resistant storability of the toner declines, and there is a particular problem with so-called blocking in which toner particles fuse together in high-temperature environments.

One technique that is known for solving this problem is to use a crystalline resin in the toner. Because crystalline resins soften rapidly at the melting point of the resin, the softening temperature of the toner can be lowered to near the melting point while maintaining heat-resistant storability below the melting point. Thus, both low temperature fixability and heat-resistant storability can be achieved by using a crystalline resin in the toner.

Meanwhile, an effective means for reducing the size of the device is to reduce the size of the fixing unit mounted on the main body for example. Film fixing is used by preference because it makes it easier to simplify the heat source and the device configuration. However, because film fixing generally uses a small heat quantity and low pressure, less heat is likely to be transmitted to the toner, and the toner does not melt readily. This can result in image defects in which isolated toner on the fixed image causes color transfer when the image is rubbed due to insufficient melting of the toner.

To solve this problem, the melt viscosity on the toner particle surface is important. Specifically, if the melt viscosity near the toner particle surface can be lowered, it will then be possible to suppress the image defects described above because the toner particles will fuse together during fixing, forming network structures. Because fixing by networks formed by toner surface melting is particularly important in low pressure fixing units, one technique is to control the crystalline resin so that it is easily present on the toner particle surface.

However, the molecular chains of crystalline resins have a uniform, regular orientation and low resistance, and are thus liable to charge leakage. Thus, if the crystalline resin is exposed on the toner particle surface the amount of low-charge toner increases, and toner that does not reach the desired charge is developed on non-image areas, causing problems of fogging.

Due to the orientation of the crystalline resin as described above, moreover, it is fragile and has the property of breaking easily. Thus, although low temperature fixability against rubbing is improved if the crystalline resin is controlled so that it is localized on the toner particle surface, when stored text is folded and stored for a long period of time, image peeling at the folds and cracks in the image are likely.

There is thus demand for a toner that provides good low temperature fixability while suppressing fogging due to low-charge toner and image peeling of folded images.

There have been various proposals in the past for solving these problems.

In the toner particle described in Japanese Patent Application Publication No. 2015-169770 low temperature fixability and charging stability are improved with a core-shell structure having two shell layers comprising a layer of an amorphous resin as the outermost layer outside a layer of a crystalline resin.

In the toner particle of Japanese Patent Application Publication No. 2011-149986, low temperature fixability and heat-resistant storability are improved by using a crystalline resin and an amorphous resin in the shell layer of a core-shell structure.

SUMMARY OF THE INVENTION

However, because the invention of Japanese Patent Application Publication No. 2015-169770 has an amorphous resin layer, the melt viscosity of the toner particle surface is not lowered sufficiently, and because it uses a crystalline resin, the effect of improving low temperature fixability against rubbing may not be sufficiently obtained.

Moreover, because this toner is configured with the crystalline resin and amorphous resin in a phase-separated state, the crystalline resin is also likely to form domains in the fixed image without compatibilizing with the amorphous resin. This is likely to detract from the folding strength conferred by the crystalline polyester domains.

In Japanese Patent Application Publication No. 2011-149986, moreover, it has been found that fogging is likely, because large quantities of the crystalline resin are exposed in the shell layer.

Moreover, it has been found that if the crystalline resin ratio in the shell layer is lowered in an effort to improve the charging characteristics, low temperature fixability declines, and it is difficult to achieve both low temperature fixability and charging performance.

The present invention provides a toner whereby good low temperature fixability can be obtained while suppressing fogging caused by low-charge toner and image peeling during folding.

A toner comprising a toner particle that contains a resin component, wherein the resin component contains an amorphous polyester and a crystalline polyester, and in depth profile measurement of secondary ions on the toner particle surface by time-of-flight secondary ion mass spectrometry TOF-SIMS, given Ia(t) as the intensity of secondary ions derived from the amorphous polyester, Ic(t) as the intensity of secondary ions derived from the crystalline polyester, and I(t) as the total detected intensity of secondary ions derived from resin contained in the toner particle at a depth of t (nm) from the toner particle surface, the following formulae (1) and (2) are satisfied within the range of $0 \leq t \leq 10$:

$$Ia(t) > Ic(t) > 0.0000 \quad (1)$$

$$(Ia(t) + Ic(t))/I(t) \geq 0.80 \quad (2)$$

and there is only one point of intersection between the depth profile curve of Ia(t) and the depth profile curve of Ic(t) within the range of $10 < t \leq 30$.

The present invention can provides a toner whereby good low temperature fixability can be obtained while suppressing fogging caused by low-charge toner and image peeling during folding.

Further features of the present invention will become apparent from the following description of exemplary embodiments.

DESCRIPTION OF THE EMBODIMENTS

Unless otherwise specified, descriptions of numerical ranges such as "from XX to YY" or "XX to YY" include the numbers at the upper and lower limits of the range.

As discussed above, a core-shell toner comprising an amorphous resin layer coated on a core particle containing a crystalline resin as in Japanese Patent Application Publication No. 2015-169770 is effective for improving the charging characteristics of the toner. However, this is insufficient for achieving both low temperature fixability and charging characteristics unless the thickness of the amorphous resin layer and its relationship with the crystalline resin can be precisely controlled. In particular, image defects due to insufficient toner melting can be conspicuous in low pressure fixing unit configurations such as film fixing.

The inventors conducted extensive research into toner structures that could provide excellent low temperature fixability as well as strong charging characteristics while at the same time preventing image peeling of the fixed image during folding.

The inventors' investigations using toner melting simulation have shown that the presence of crystalline resin in a region up to a depth of about 60 nm from the toner particle surface is important for melting near the surface of the toner. Consequently, in low pressure fixing unit configurations such as film fixing, adding a crystalline resin to the toner particle to lower the melt viscosity up to a depth of about 60 nm from the toner particle surface is effective for achieving excellent low temperature fixability.

When large quantities of a crystalline resin are exposed on the toner particle surface, however, fogging may occur due to charging insufficiency. Thus, to achieve both low temperature fixability and charging characteristics, it is necessary to dispose a sufficient quantity of a crystalline resin in a region up to a depth of about 60 nm from the toner particle surface while also precisely controlling the structure of an amorphous resin with excellent charging characteristics so as to prevent the crystalline resin from being exposed on the toner particle surface.

The inventors therefore focused on a crystalline polyester and amorphous polyester as the crystalline resin and amorphous resin, respectively. The physical properties of polyester resins can be easily controlled by means of their monomer compositions, and using polyester resins for both the crystalline and amorphous resins makes it is easier to control their structures and compatibility.

The inventors discovered that the above problems could be solved with the following toner.

That is, this is a toner having a toner particle containing a resin component, wherein the resin component contains an amorphous polyester and a crystalline polyester, and in depth profile measurement of secondary ions on the toner particle surface by time-of-flight secondary ion mass spectrometry TOF-SIMS, given Ia(t) as the intensity of the secondary ions derived from the amorphous polyester in the toner particle at a depth of t (nm) from the toner particle surface, Ic(t) as the intensity of the secondary ions derived from the crystalline polyester in the toner particle at a depth of t (nm) from the toner particle surface, and I(t) as the total detected intensity of secondary ions derived from resin contained in the toner particle at a depth of t (nm) from the toner particle surface, the following formulae (1) and (2) are satisfied within the range of $0 \le t \le 10$:

$$Ia(t) > Ic(t) > 0.0000 \quad (1)$$

$$(Ia(t)+Ic(t))/I(t) \ge 0.80 \quad (2)$$

and there is only one point of intersection between the depth profile curve of Ia(t) and the depth profile curve of Ic(t) within the range of $10 < t \le 30$.

The present invention is explained in detail below.

Formula (1) above shows that the toner particle has both an amorphous polyester and a crystalline polyester in the region up to a depth of 10 nm from the toner particle surface. It also shows that the amount of the amorphous polyester is greater than the amount of the crystalline polyester in this region.

Formula (2) above shows that the amorphous polyester and crystalline polyester together constitute at least 80% of the resin component in the region up to a depth of 10 nm from the toner particle surface.

That is, by controlling the toner so that formulae (1) and (2) above are satisfied simultaneously in the above region, it is possible to dispose the crystalline polyester near the toner particle surface where it is effective for low temperature fixability, while also minimizing the amount of the crystalline polyester that is exposed on the toner particle surface. Good charging characteristics can be achieved as a result.

Within the range of $0 \le t \le 10$, Ia(t)-Ic(t) is preferably 0.0050 to 0.0350, or more preferably 0.0050 to 0.0300.

Within the range of $0 \le t \le 10$, (Ia(t)+Ic(t))/I(t) is preferably at least 0.85, or more preferably at least 0.88. There is no particular upper limit, but preferably it is not more than 0.99, or more preferably not more than 0.95.

Within the range of $0 \le t \le 10$, Ia(t) can be controlled by controlling the molecular weight and SP value of the amorphous polyester, the difference between the SP values of the amorphous polyester and crystalline polyester, and the content of the amorphous polyester in the resin component. Ic(t) can be controlled by controlling the molecular weight and SP value of the crystalline polyester, the difference between the SP values of the crystalline polyester and amorphous polyester, and the content of the crystalline polyester in the resin component. (Ia(t)+Ic(t))/I(t) can be controlled by controlling the SP values, molecular weights and contents of the amorphous polyester and crystalline polyester.

The fact that there is only one point of intersection between the depth profile curve of Ia(t) and the depth profile curve of Ic(t) within the range of $10 < t \le 30$ indicates the following structure. That is, it indicates that in the region of larger than 10 nm and not larger than 30 nm from the toner particle surface moving towards the center of the particle, the abundances of the amorphous polyester and crystalline polyester change continuously. Moreover, the amorphous polyester is more abundant at the toner particle surface than at the point of intersection, while the crystalline polyester is more abundant inside the toner particle than at the point of intersection.

As discussed above, a structure having a sufficient amount of crystalline polyester in the region up to a depth of 60 nm from the toner particle surface is necessary for obtaining excellent low temperature fixability. Without a structure in which the abundances of the amorphous polyester and crystalline polyester replace themselves up to the intermediate depth of 30 nm from the toner particle surface, a sufficient amount of crystalline polyester cannot be present up to a depth of 60 nm from the toner particle surface. If these conditions are not satisfied, excellent low temperature fixability may not be obtained due to insufficient toner melting.

Rather than a structure in which the amorphous resin and crystalline resin form phase-separated layers as in Japanese Patent Application Publication No. 2015-169770, the toner of the present invention has a structure in which the abundances of the amorphous polyester and crystalline polyester change continuously from the toner particle surface towards the toner center. Consequently, even when only the region nearest the toner surface is melted as in a low-pressure fixing unit configuration, the crystalline polyester can instantaneously plasticize the surrounding amorphous polyester and assume a state of uniform compatibility.

When such a melted toner is cooled on an image, the crystalline polyester, which is in a uniformly compatibilized state with the amorphous polyester, crystallizes in a finely dispersed state without forming large domains. As a result, it is possible to suppress image peeling of the image after fixing caused by large domains of the crystalline polyester.

To specify the structure of the toner particle, the inventors performed secondary ion depth profile measurement of the toner particle using time-of-flight secondary ion mass spectrometry TOF-SIMS, which is excellent for analyzing the outermost surface of a substance. Then, the structure of the toner particle is specified on the basis of the obtained secondary ion intensity.

In TOF-SIMS, the sample surface is irradiated with a high-speed ion beam (primary ions) in high vacuum, and secondary ions repelled from the sample surface by the sputtering phenomenon are captured, allowing secondary ions to be stably observed in a region up to about 1 μm from the sample surface.

The toner particle structure is observed using the depth profiling function of TOF-SIMS. In this process, the primary ion beam scanning area is normally a region a hundred micrometers square to a square of several hundreds of micrometers, corresponding to hundreds of toner particles.

However, it is possible to measure mainly the composition near the toner particle surface, and by etching in the depth direction of the toner particle, it is possible to measure mainly the composition of the toner particle. Particularly high-resolution depth profiles can be obtained in the shallow regions, specifically the region up to a depth of 0.5 μM from the toner particle surface, and the structure of the toner particle can be specified by analyzing the depth profiles of secondary ions corresponding to the constituent components of the toner particle.

Within the range of $0 \leq t \leq 10$, Ia(t) is preferably from 0.0300 to 0.0550, or more preferably from 0.0350 to 0.0500.

If Ia(t) is at least 0.0300, charging performance is sufficient due to the amorphous polyester, and fogging caused by low-charge toner can be controlled. If it is not more than 0.0550, on the other hand, the amorphous polyester is less likely to interfere with the reduction in melt viscosity on the toner particle surface due to the crystalline polyester.

Ia(30) is preferably 0.0100 to 0.0250, or more preferably 0.0150 to 0.0200.

Ia(60) is preferably 0.0050 to 0.0100, or more preferably 0.0050 to 0.0080.

Within the range of $0 \leq t \leq 10$, I(t) is preferably at least 0.0500, or more preferably at least 0.0550. If it is at least 0.0500, the charging characteristics of the amorphous polyester and the good low temperature fixability of the crystalline polyester can be effectively obtained. There is no particular upper limit to I(t) within the range of $0 \leq t \leq 10$, but preferably it is not more than 0.1000, or more preferably not more than 0.0750.

I(30) is preferably 0.0500 to 0.0700, or more preferably 0.0500 to 0.0600.

I(60) is preferably 0.0300 to 0.0600, or more preferably 0.0300 to 0.0400.

The point of intersection between the depth profile curve of Ia(t) and the depth profile curve of Ic(t) must be in the range of $10 < t \leq 30$, or preferably $10 < t \leq 20$.

If the position of this intersection point is greater than 10, good charging characteristics can be obtained due to the amorphous polyester present on the toner particle surface. If the location of the intersection point is not more than 30, good low temperature fixability can be obtained because the structure includes a sufficient quantity of crystalline polyester at a depth of up to 60 nm from the toner particle surface.

The position of the intersection point can be controlled by controlling the SP values, molecular weights and contents of the amorphous polyester and crystalline polyester, and the difference in SP values between the amorphous polyester and the crystalline polyester.

As discussed above, a toner whereby low temperature fixability and charging characteristics can be obtained while controlling image peeling during folding at a high level can be provided by closely controlling the states of the amorphous polyester and crystalline polyester up to a depth of about 60 nm from the toner particle surface.

Means

The means for obtaining the specific toner configuration described above are not particularly limited, but for example the toner particle is preferably manufactured in an aqueous medium using an amorphous polyester and crystalline polyester with controlled polarities and compatibility. Manufacturing in an aqueous medium makes control of a polar polyester resin to be stayed near the surface of the toner particle easier.

A method for manufacturing a toner particle by suspension polymerization is explained below as an example of a toner particle manufacturing method.

In suspension polymerization, a polymerizable monomer composition is obtained by first uniformly dispersing an amorphous polyester resin and a crystalline polyester resin together with a colorant, polymerization initiator, crosslinking agent, charge control agent and other additives as necessary in a polymerizable monomer for forming a resin component such as a binder resin. A suitable stirring apparatus is then used to disperse the resulting polymerizable monomer composition in a continuous phase (such as a water phase) containing a dispersion stabilizer to thereby form (granulate) particles of the polymerizable monomer composition, and the polymerizable monomer is subjected to a polymerization reaction using a polymerization initiator to obtain a toner particle.

The toner particle is preferably a suspension polymerized toner particle.

Examples of polymerizable monomers include:

styrenic monomers such as styrene, o-methylstyrene, m-methylstyrene, p-methylstyrene, p-methoxystyrene and p-ethylstyrene;

acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate;

methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate;

as well as acrylonitrile, methacrylonitrile and acrylamide.

The polymerizable monomer may be used as a single type, or alternatively two or more types may be used concomitantly.

Among the above polymerizable monomers there are preferably used a styrenic monomer alone, or a styrenic monomer concomitantly with another polymerizable monomer such as an acrylic acid ester or methacrylic acid ester. That is because in that case the structure of the toner particle is controlled, and the low temperature fixability and charging characteristics of the toner are readily enhanced.

Preferably, in particular, a styrenic monomer and at least one selected from the group consisting of an alkyl acrylate ester and an alkyl methacrylate ester is used as a main component. That is, the resin component contains preferably a styrene acrylic resin.

Preferably the polymerization initiator used for producing the toner particle in accordance with a suspension polymerization method has a half-life from 0.5 hours to 30 hours at the time of the polymerization reaction. Preferably, the polymerization initiator is used in an amount from 0.5 parts by mass to 20 parts by mass relative to 100 parts by mass of the polymerizable monomer. Thereby it becomes possible to obtain a polymer having a molecular weight maximum from 5000 to 50000, and to impart preferred strength and appropriate melt characteristics to the toner particle.

From the viewpoint of fixing performance and mechanical strength, the peak molecular weight (Mp) of the styrene acrylic resin is preferably from 10000 to 35000, and more preferably from 15000 to 30000.

Examples of the polymerization initiator include:

azo or diazo polymerization initiators such as 2,2'-azobis-(2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl)peroxydicarbonate and di(sec-butyl)peroxydicarbonate.

Preferred among the foregoing is t-butyl peroxypivalate.

The polymerization initiator may be used as a single type, or alternatively two or more types may be used concomitantly.

A crosslinking agent may be used during production of the toner particle in accordance with a suspension polymerization method. The amount of crosslinking agent is preferably from 0.001 parts by mass to 15 parts by mass relative to 100 parts by mass of the polymerizable monomer.

Examples of the crosslinking agent include compounds having two or more polymerizable double bonds, for instance aromatic divinyl compounds such as divinylbenzene and divinylnaphthalene;

carboxylic acid esters having two double bonds, such as ethylene glycol diacrylate, ethylene glycol dimethacrylate and 1,3-butanediol dimethacrylate;

divinyl compounds such as divinylaniline, divinyl ether, divinyl sulfide and divinyl sulfone; and compounds having three or more vinyl groups.

The crosslinking agent may be used as a single type, or alternatively two or more types may be used concomitantly.

When the resin component includes a styrene acrylic resin, the content ratio of the styrene acrylic resin in the resin component is preferably from 50 mass % to 99 mass %, or more preferably from 60 mass % to 95 mass %.

When the resin component includes a styrene acrylic resin, moreover, in depth profile measurement of secondary ions on the toner particle surface by time-of-flight secondary ion mass spectrometry TOF-SIMS, given Ic(t) as the intensity of the secondary ions derived from the crystalline polyester and Is(t) as the intensity of the secondary ions derived from the styrene acrylic resin at a depth of t (nm) from the toner particle surface, preferably formula (6) below is satisfied, and more preferably formula (6') below is satisfied within the range of $0 \le t \le 30$.

$$Ic(t) > Is(t) \tag{6}$$

$$0.0100 \le Ic(t) - Is(t) \le 0.0350 \tag{6'}$$

Within this range, melt viscosity is sufficiently reduced on the toner particle surfaced during fixing, and the low temperature fixability of the toner is improved.

Within the range of $0 \le t \le 30$, Ic(t) can be controlled by controlling the molecular weight and SP value of the crystalline polyester, the difference in SP values between the crystalline polyester and the amorphous polyester, and the content of the crystalline polyester in the resin component.

Moreover, in depth profile measurement of secondary ions on the toner particle surface by time-of-flight secondary ion mass spectrometry TOF-SIMS, given I(t) as the total detected intensity of secondary ions derived from resin contained in the toner particle and Is(t) as the intensity of the secondary ions derived from the styrene acrylic resin at a depth of t (nm) from the toner particle surface, preferably formula (7) below is satisfied, and more preferably formula (7') is satisfied within the range of $30 < t \le 60$.

$$0.10 \le Is(t)/I(t) \le 0.50 \tag{7}$$

$$0.20 \le Is(t)/I(t) \le 0.45 \tag{7'}$$

Offset resistance is improved in formula (7) is satisfied.

Within the range of $30 < t \le 60$, I(t) can be controlled by controlling the irradiation dose of primary ions in time-of-flight secondary ion mass spectrometry TOF-SIMS.

A saturated polyester, an unsaturated polyester or both may be selected appropriately as the amorphous polyester.

An ordinary polyester produced from an alcohol component and an acid component may be used as the amorphous polyester, and examples of these two components are given below.

Examples of the alcohol component include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, the bisphenol represented by formula (A) below and its derivatives, and the diol represented by formula (B) below and the like.

(A)

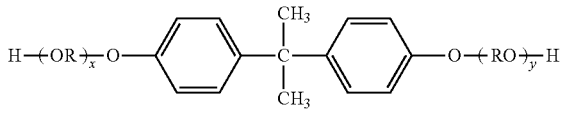

(In formula (A), R is an ethylene or propylene group, x and y are each 0 or an integer greater than 0, and the average of x+y is 0 to 10.)

(B)

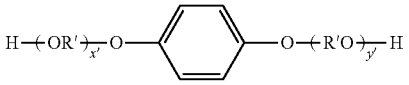

(in the formula, R' is

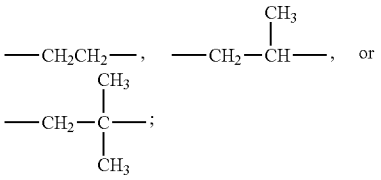

x' and y' are each an integer of 0 or more; and the average value of x'+y' is 0 to 10).

Examples of trihydric or higher alcohols that can be used in preparing the amorphous polyester include sorbitol, 1,2,3,6-hexanetetrol, 1,4-sorbitan, pentaerythritol, dipentaerythritol, tripentaerythritol, 1,2,4-butanetriol, trimethylol ethane, trimethylol propane, 1,3,5-trihydroxymethyl benzene and the like.

Examples of divalent carboxylic acids that can be used in preparing the amorphous polyester include dicarboxylic acids and derivatives thereof such as benzenedicarboxylic acids and their anhydrides and lower alkyl esters, including phthalic acid, terephthalic acid, isophthalic acid and phthalic anhydride; alkyldicarboxylic acids such as succinic acid, adipic acid, sebacic acid and azelaic acid, and their anhydrides and lower alkyl esters; alkenylsuccinic acids or alkylsuccinic acids such as n-dodecenylsuccinic acid and n-dodecylsuccinic acid, and their anhydrides and lower alkyl esters; and unsaturated dicarboxylic acids such as fumaric acid, maleic acid, citraconic acid and itaconic acid, and their anhydrides and lower alkyl esters and the like. A benzenedicarboxylic acid such as terephthalic acid or isophthalic acid is desirable from the standpoint of handling and reactivity.

Examples of trivalent or higher polycarboxylic acid components that can be used in the amorphous polyester include polycarboxylic acids and derivatives thereof such as trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl) methane, 1,2,7,8-octanetetracarboxylic acid, Empol trimer acid, and anhydrides and lower alkyl esters of these; and tetracarboxylic acids represented by formula (C) below and the like, and anhydrides and lower alkyl esters of these.

(C)

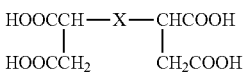

(In formula (C), X represents an alkylene or alkenylene group. However, X is a $C_{5-30}$ substituent having at least 1 side chain with 3 or more carbon atoms.)

Further examples of the alcohol component include polyhydric alcohols such as glycerin, pentaerythritol, sorbitol, sorbitan, and oxyalkylene ethers of Novolac type phenolic resins and the like, while examples of the acid component include polycarboxylic acids such as trimellitic acid, pyromellitic acid, 1,2,3,4-butanetetracarboxylic acid, benzophenone tetracarboxylic acid, and anhydrides of these and the like.

Any raw material monomers may be used for the crystalline polyester without any particular limitations as long they do not detract from the crystallinity.

"Crystalline" means that having a clear endothermic peak (melting point) in differential scanning calorimetry DSC. Conversely, a resin that does not exhibit a clear endothermic peak is amorphous.

The crystalline polyester may also be a hybrid resin having polyester segments and vinyl segments. For example, the content of polyester segments is preferably 50 mass % to 100 mass %, or more preferably 80 mass % to 100 mass %.

The crystalline polyester is preferably a condensation polymer of monomers that include a linear aliphatic dicarboxylic acid and a linear aliphatic diol. The monomers of the aforementioned amorphous polyester may also be used as long as the product is crystalline.

More preferably, the principal component of the crystalline polyester is a polyester produced from monomers that include a linear aliphatic dicarboxylic acid represented by formula (X) below and a linear aliphatic diol represented by formula (Y) below. "Principal component" means that the content thereof is at least 50 mass %.

$$HOOC—(CH_2)_m—COOH \quad (X)$$

[In the formula, m is an integer from 2 to 14.]

$$HO—(CH_2)_n—OH \quad (Y)$$

[In the formula, n is an integer from 2 to 16.]

Because a linear polyester constituted from a dicarboxylic acid represented by the formula (X) above and a diol represented by the formula (Y) above has excellent crystallinity, it does not remain compatibilized with the amorphous polyester in the toner and can provide good heat-resistant storability.

When m in the formula (X) and n in the formula (Y) are at least 2, low temperature fixability is excellent because the melting point (Tm) is within the desired range for toner fixing. From a practical standpoint, the materials are easier to obtain if m in the formula (X) is not more than 14 and n in the formula (Y) is not more than 16.

A monovalent acid such as acetic acid or benzoic acid or a monohydric alcohol such as cyclohexanol benzyl alcohol may also be used as necessary to adjust the acid value, hydroxyl value or the like.

The crystalline polyester may be manufactured by a normal polyester synthesis method. For example, the crystalline polyester can be obtained by subjecting the dicarboxylic acid component and dialcohol component to an esterification reaction or ester exchange reaction, and then performing a polycondensation reaction by ordinary methods in vacuum or in introduced nitrogen gas.

An ordinary esterification catalyst or ester exchange catalyst such as sulfuric acid, t-butyl titanium butoxide, dibutyl tin oxide, manganese acetate or magnesium acetate may be used as necessary during the esterification or ester exchange reaction. An ordinary known polymerization catalyst such as tert-butyl titanium butoxide, dibutyl tin oxide, tin acetate, zinc acetate, tin disulfide, antimony trioxide or germanium dioxide for example may also be used for polymerization.

The polymerization temperature and amount of the catalyst are not particularly limited, and any may be selected as necessary.

A titanium catalyst is preferably used as the catalyst, and a chelate type titanium catalyst is more preferred. A titanium catalyst has suitable reactivity and yields a polyester with a desirable molecular weight distribution.

The acid value of the crystalline polyester can also be controlled by blocking the terminal carboxyl groups of the polymer. A monocarboxylic acid or monoalcohol can be used for terminal blocking.

Examples of monocarboxylic acids include benzoic acid, naphthalene carboxylic acid, salicylic acid, 4-methylbenzoic acid, 3-methylbenzoic acid, phenoxyacetic acid, biphenyl carboxylic acid, acetic acid, propionic acid, butyric acid, octanoic acid, decanoic acid, dodecanoic acid, stearic acid and the like.

Methanol, ethanol, propanol, isopropanol, butanol or a higher alcohol can be used as the monoalcohol.

Given SP1 $(cal/cm^3)^{1/2}$ as the SP value of the crystalline polyester and SP2 $(cal/cm^3)^{1/2}$ as the SP value of the amorphous polyester, SP2-SP1 is preferably from 3.00 to 3.70, or more preferably from 3.00 to 3.40.

As discussed above, the toner particle is preferably manufactured in an aqueous medium. Consequently, if SP2-SP1 is from 3.00 to 3.70, the high-SP amorphous polyester becomes localized so that it covers the toner particle surface, while part of the crystalline polyester becomes compatibilized with the amorphous polyester. It is thus possible to achieve both low temperature fixability and charging characteristics.

If SP2-SP1 is at least 3.00, the crystalline polyester is less likely to be exposed on the toner particle surface because the amorphous polyester and crystalline polyester do not compatibilize more than necessary when the toner particle is granulated. The charging characteristics are appropriate as a result, and fogging is suppressed.

If SP2-SP1 is not more than 3.70, on the other hand, the amorphous polyester and crystalline polyester are in a state of moderate compatibility. As a result, the crystalline polyester forms domains inside the toner particle, and the abundance of the crystalline polyester is appropriate at a depth range of about 60 nm from the toner particle surface. The plasticizing effect of the crystalline polyester on the amorphous polyester during fixing is thereby improved, resulting in good low temperature fixability.

The SP values used in the present invention are calculated by the commonly used methods of Fedors [Poly. Eng. Sci., 14(2), 147 (1974)] based on the types and ratios of the monomer constituting the resin and hydrophobizing agent.

An SP value can be controlled by controlling the types and amounts of monomers. A monomer with a high SP value may be used for example to increase an SP value. On the other hand, a monomer with a low SP value can be used to decrease an SP value. SP values are given in units of $(cal/cm^3)^{1/2}$ but can also be converted to units of $(J/m^3)^{1/2}$ using the formula 1 $(cal/cm^3)^{1/2}=2.046\times10^3\ (J/m^3)^{1/2}$.

The SP value SP2 of the amorphous polyester is preferably from 12.40 to 12.90. If it is at least 12.40, good charging performance can be obtained, while if it is not more than 12.90, good fixing performance can be obtained. An SP2 of from 12.50 to 12.80 is more preferred.

The amorphous polyester is preferably a condensation polymer of a dicarboxylic acid component and a dialcohol component containing a bisphenol A alkylene oxide adduct with an average of from 3.0 to 5.0 added moles of alkylene oxide, and the alkylene oxide is preferably selected from ethylene oxide and propylene oxide (more preferably propylene oxide). The average added moles are preferably from 4.0 to 5.0.

If the average added moles of the alkylene oxide are at least 3.0, more flexible sites are present, the mobility of the main skeleton of the resin increases, and toughness is easier to obtain because stickiness is increased. As a result, image peeling (cracks in the image) is easily suppressed even in severe low-temperature, low-humidity environments when the image is folded after being fixed.

If the average added moles are at not more than 5.0, on the other hand, it is easier to suppress fixing inhibition due to high molecular weight.

In the di alcohol component, the content of the bisphenol A alkylene oxide adduct with an average of from 3.0 to 5.0 added moles of alkylene oxide is preferably 50 mol % to 100 mol %, or more preferably 80 mol % to 100 mol %.

The weight-average molecular weight (Mw) of the amorphous polyester is preferably from 7000 to 20000. If the Mw is at least 7000, it is easier to prevent a decline in the heat-resistant storability of the toner. If the Mw is not more than 20000, fixing inhibition can be suppressed. The Mw is more preferably from 9000 to 15000.

The melting point Tm (C) of the crystalline polyester resin is preferably from 55° C. to 90° C., or more preferably from 60° C. to 85° C. If it is at least 55° C., the toner has good heat-resistant storability. On the other hand, low temperature fixability is good if the melting point is not more than 90° C.

The weight-average molecular weight Mw of the crystalline polyester is preferably from 3000 to 50000. If the weight-average molecular weight (Mw) of the crystalline polyester is at least 3000, the heat-resistant storability and offset resistance of the toner are improved. If it is not more than 50000, fixing performance is good. More preferably the Mw is from 15000 to 40000.

The content of the crystalline polyester in the resin component is preferably 5 mass % to 85 mass %, or more preferably 10 mass % to 80 mass %.

When the resin component includes a styrene acrylic resin, the content of the crystalline polyester is preferably from 3 mass parts to 20 mass parts or more preferably from 5 mass parts to 20 mass parts per 100 mass parts of the styrene acrylic resin. If it is at least 3 mass parts, the aforementioned effects of the invention are easily obtained. If it is not more than 20 mass parts, the content of the low-molecular-weight component of the crystalline polyester is not too high in the toner, and heat-resistant storability is less likely to decline.

The content of the amorphous polyester in the resin component is preferably 1 mass % to 35 mass %, or more preferably 2 mass % to 30 mass %.

When the resin component includes a styrene acrylic resin, the content of the amorphous polyester is preferably from 2 mass parts to 15 mass parts or more preferably from 2 mass parts to 10 mass parts per 100 mass parts of the styrene acrylic resin.

The ratio of the crystalline polyester content to the amorphous polyester content (mass ratio: CPES/APES) is preferably 1 to 10, or more preferably 2 to 5.

The acid value of the crystalline polyester is preferably from 0.1 mg KOH/g to 5.0 mg KOH/g, or more preferably from 0.5 mg KOH/g to 4.0 mg KOH/g. If the acid value is within this range, the crystallinity of the crystalline polyester can be increased, toner deterioration can be suppressed during long-term use in high-temperature, high-humidity environments, and fogging can be further suppressed. The acid value can be controlled by controlling the compositional ratios of the monomer during polymerization.

The SP value SP1 of the crystalline polyester is preferably from 9.45 to 9.80, or more preferably from 9.50 to 9.70.

In depth profile measurement of secondary ions on the toner particle surface by time-of-flight secondary ion mass spectrometry TOF-SIMS, given Ic(0) as the intensity of secondary ions derived from the crystalline polyester at t=0 (that is, on the outermost surface of the toner particle) and I(0) as the total detected intensity of secondary ions derived from resin contained in the toner particle at t=0, the following formula (3) is preferably satisfied, and more preferably the following formula (3') is satisfied.

$$0.10 \leq Ic(0)/I(0) \leq 0.40 \quad (3)$$

$$0.20 \leq Ic(0)/I(0) \leq 0.30 \quad (3')$$

If the ratio is at least 0.10, fixing performance and toughness of the fixed image are improved, while good charging performance is obtained if it is not more than 0.40.

The Ic(0) can be controlled by controlling the molecular weight and SP value of the crystalline polyester, the difference in SP values between the crystalline polyester and the amorphous polyester, and the content of the crystalline polyester in the resin component. The I(0) can be controlled by controlling the irradiation dose of primary ions in time-of-flight secondary ion mass spectrometry TOF-SIMS.

Moreover, in depth profile measurement of secondary ions on the toner particle surface by time-of-flight secondary ion mass spectrometry TOF-SIMS, given Ic(30) as the intensity of secondary ions derived from the crystalline polyester at t=30 (that is, at a depth of 30 (nm) from the toner particle surface) and I(30) as the total detected intensity of secondary ions derived from resin contained in the toner particle at t=30, preferably the following formula (4) is satisfied, and more preferably the following formula (4') is satisfied.

$$0.40 < Ic(30)/I(30) \leq 0.90 \quad (4)$$

$$0.40 \leq Ic(30)/I(30) \leq 0.60 \quad (4')$$

If the ratio is above 0.40, low temperature fixability is dramatically improved because a sufficient quantity of the crystalline polyester melts instantaneously during fixing even with a low-pressure fixing unit configuration such as film fixing. If it is not more than 0.90 offset resistance is improved, and peeling of the image after fixing can be suppressed.

The Ic(30) can be controlled by controlling the molecular weight and SP value of the crystalline polyester, the difference between the SP values of the crystalline polyester and amorphous polyester, and the content of the crystalline polyester in the resin component. The I(30) can be controlled by controlling the irradiation dose of primary ions in time-of-flight secondary ion mass spectrometry TOF-SIMS.

In depth profile measurement of secondary ions on the toner particle surface by time-of-flight secondary ion mass spectrometry TOF-SIMS, Ic(t) preferably satisfies the following formula (5), and more preferably satisfies the following formula (5') in the range of $0 \leq t \leq 10$.

$$0.0100 \leq Ic(t) \leq 0.0350 \quad (5)$$

$$0.0150 \leq Ic(t) \leq 0.0300 \quad (5')$$

If the Ic(t) is at least 0.0100, the melt viscosity of the toner particle surface can be effectively lowered by the crystalline polyester, and image peeling of the image after fixing can be controlled. The fixing performance and the toughness of the fixed image are improved as a result. If it is not more than 0.0350, the charging performance is improved, and fogging caused by low-charge toner can be suppressed.

The Ic(30) is preferably 0.0150 to 0.0500, or more preferably 0.0200 to 0.0500.

The Ic(60) is preferably 0.0100 to 0.0300, or more preferably 0.0100 to 0.0200.

The weight-average particle diameter D4 of the toner particle is preferably from 4.00 μm to 15.00 μm, or more preferably from 5.00 μm to 8.00 μm. If the weight-average particle diameter (D4) is within this range, good flowability is obtained, fogging due to low-charge toner is suppressed because triboelectric charging is easier in the regulating part, and development can be faithful to the latent image.

As the toner there can be used any toner from among a magnetic single-component toner, a non-magnetic single-component toner, and a toner for non-magnetic two-component developers.

A magnetic body is preferably used as the colorant in a case where a magnetic single-component toner is used as the toner.

Examples of magnetic bodies used in a magnetic single-component toners include:

magnetic iron oxides such as magnetite, maghemite and ferrite, and magnetic iron oxides including other metal oxides;

metals such as Fe, Co, Ni, or alloys of these metals and Al, Co, Cu, Pb, Mg, Ni, Sn, Zn, Sb, Be, Bi, Cd, Ca, Mn, Se, Ti, W or V, as well as mixtures of the foregoing.

Magnetite is preferred among these magnetic bodies. Examples of the shape of magnetite include polyhedral, octahedral, hexahedral, spherical, needle-like and scale-like shapes. From among these shapes, a less anisotropic shape such as polyhedral, octahedral, hexahedral or spherical shape is preferred in terms of improving image density.

The volume-average particle diameter of the magnetic body is preferably from 0.10 μm to 0.40 μm. When the volume-average particle diameter is 0.10 μm or larger, the magnetic bodies are unlikelier to aggregate, and homogeneous dispersibility of the magnetic body in the toner particle is enhanced. The tinting strength of the toner is enhanced when the volume-average particle diameter is 0.40 μm or smaller.

The volume-average particle diameter of the magnetic body can be measured using a transmission electron microscope. Specifically, a toner to be observed is dispersed sufficiently in an epoxy resin, and is thereafter cured in the atmosphere, at a temperature of 40° C. over 2 days, to yield a cured product. The obtained cured product is sliced using a microtome, and the particle size of 100 magnetic bodies is measured in the field of view of a photograph at a magnification from 10000× to 40000×, in a transmission electron microscope (TEM). The volume-average particle size is then calculated on the basis of a circle-equivalent diameter that is equal to the projected area of each magnetic body. Alternatively, the volume-average particle diameter of the magnetic body can be measured using an image analysis device.

The content of the magnetic body in the toner particle is preferably from 30 parts by mass to 120 parts by mass, and more preferably from 40 parts by mass to 110 parts by mass, relative to 100 parts by mass of the resin component of the toner particle.

The magnetic body used in the toner can be produced for instance in accordance with the following method.

To an aqueous solution of a ferrous salt, an alkali such as sodium hydroxide is added, in an amount of one equivalent or more with respect to the iron component, to thereby prepare an aqueous solution containing ferrous hydroxide. Air is blown into the prepared aqueous solution while the pH of the solution is kept at 7 or higher, and an oxidation reaction of the ferrous hydroxide is conducted next, while under warming of the aqueous solution at 70° C. or above, to thereby initially form seed crystals that constitute the cores of the magnetic bodies.

An aqueous solution containing 1 equivalent of ferrous sulfate, referred to the amount of the previously added alkali, is added to a slurry-like solution containing the seed crystals. The reaction of ferrous hydroxide is allowed to proceed while the pH of the solution is maintained at 5 to 10 and air is blown in, to thereby grow magnetic iron oxide particles using the seed crystals as cores. The shape and magnetic characteristics of the magnetic body can be controlled through adjustment of the pH, the reaction temperature and stirring conditions. The pH of the solution becomes increasingly acidic as the oxidation reaction proceeds. The pH of the solution should however not be lower than 5.

A magnetic body can then be obtained by filtering, washing and drying the magnetic iron oxide particles thus obtained.

In a case where the toner is produced in accordance with a polymerization method, the surface of the magnetic body is preferably subjected to a hydrophobic treatment. In the case of a surface treatment by a dry process, the surface of the washed, filtered and dried magnetic body can be subjected to a coupling agent treatment.

In the case of a surface treatment by a wet process, once the oxidation reaction is over the resulting dried product is thereafter re-dispersed, or alternatively, the iron oxide obtained through washing and filtration after the oxidation reaction is over is re-dispersed, without being dried, in another aqueous medium, where a coupling treatment can then be performed.

In the case of re-dispersion, specifically, a coupling treatment can be carried out by adding a silane coupling agent while under stirring of the re-dispersed solution, and by raising the temperature after hydrolysis, or alternatively, by adjusting the pH of the re-dispersed solution to an alkaline region.

From the viewpoint of carrying out a uniform surface treatment it is preferable, among the foregoing, to perform filtration and washing once the oxidation reaction is over, and thereafter, to make the product as-is into a re-slurry, without drying, and to perform then a surface treatment.

In a case where the surface treatment of the magnetic body is of wet type, i.e. with a coupling agent in an aqueous medium, firstly the magnetic body is dispersed to a primary particle size in the aqueous medium, and is then stirred using a stirring blade so as to preclude settling and aggregation. Next, an appropriate amount of a coupling agent is added to the dispersion, and the surface treatment is performed while the coupling agent is hydrolyzed; in this case as well, the surface treatment is carried out, while eliciting dispersion so as to preclude aggregation, using a device such as a pin mill or a line mill.

The aqueous medium is a medium having water as a main component. For instance, the aqueous medium may be water itself, a medium of water having a small amount of a surfactant added thereto, a medium of water having a pH adjuster added thereto, or a medium of water having an organic solvent added thereto.

The surfactant is preferably a nonionic surfactant such as polyvinyl alcohol. Preferably, the surfactant is added to the aqueous medium so that the concentration of the surfactant is from 0.1 mass % to 5.0 mass %.

Examples of pH adjusters include inorganic acids such as hydrochloric acid.

Examples of organic solvents include for alcohols.

Examples of the coupling agent that can be used in the surface treatment of the magnetic body include silane coupling agents and titanium coupling agents. Silane coupling agents are preferred among the foregoing, and more preferably silane coupling agent represented by Formula (E) below.

$$R_m—Si—Y_n \quad (E)$$

Where, R represents an alkoxy group (preferably an alkoxy group having from 1 to 3 carbon atoms); m represents an integer from 1 to 3; Y represents an alkyl group (preferably an alkyl group having from 2 to 20 carbon atoms), a phenyl group, a vinyl group, an epoxy group, an acrylic group or a methacrylic group; m and n represent, each independently, an integer from 1 to 3; provided that m+n=4.

Examples of the silane coupling agent represented by Formula (E) include:

vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane and n-octadecyltrimethoxysilane.

Among the foregoing an alkyltrialkoxysilane coupling agent represented by the following general Formula (F) is preferably used, from the viewpoint of imparting high hydrophobicity to the magnetic body.

$$C_pH_{2p+1}—Si—(OC_qH_{2q+1})_3 \quad (F)$$

Where, p represents an integer from 2 to 20, and q represents an integer from 1 to 3.

Sufficient hydrophobicity can be imparted to the magnetic body when p in Formula (F) is 2 or greater. Coalescing of magnetic bodies can be suppressed when p is 20 or smaller. Sufficient hydrophobicity can be imparted to the magnetic body, with good reactivity of the silane coupling agent, when q is 3 or smaller.

Preferably, p in Formula (F) is an integer from 3 to 15, and q is preferably 1 or 2.

In a case where a hydrophobic treatment agent such as a silane coupling agent is used, the treatment may be carried out using one type of agent alone, or may be carried out using two or more types concomitantly. When two or more types are used concomitantly, the treatment may be carried out using the hydrophobic treatment agents separately, or simultaneously.

The total treatment amount of the coupling agents that are used is preferably from 0.9 parts by mass to 3.0 parts by mass relative to 100 parts by mass of the magnetic body; the amount of the treatment agent can be adjusted for instance depending on the surface area of the magnetic body and the reactivity of the coupling agent.

Examples of colorants other than the magnetic body include the following.

Carbon black such as furnace black, channel black, acetylene black, thermal black and lamp black.

Pigments and dyes can be used as a yellow colorant. Examples of pigments include C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183 and 191, and C.I. Vat Yellow 1, 3 and 20.

Examples of dyes include C.I. Solvent Yellow 19, 44, 77, 79, 81, 82, 93, 98, 103, 104, 112 and 162. The foregoing may be used as a single type, or alternatively two or more types may be used concomitantly.

Pigments and dyes can be used as a cyan colorant. Examples of pigment include C.I. Pigment Blue 1, 7, 15, 15; 1, 15; 2, 15; 3, 15; 4, 16, 17, 60, 62 and 66; C.I. Vat Blue 6; and C.I. Acid Blue 45.

Examples of dyes include C.I. Solvent Blue 25, 36, 60, 70, 93 and 95. The foregoing may be used as a single type, or alternatively two or more types may be used concomitantly.

Pigments and dyes can be used as a magenta colorant. Examples of pigments include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48; 2, 48; 3, 48:4, 49, 50, 51, 52, 53, 54, 55, 57, 57; 1, 58, 60, 63, 64, 68, 81, 81; 1, 83, 87, 88, 89, 90, 112, 114, 122, 123, 144, 146, 150, 163, 166, 169, 177, 184, 185, 202, 206, 207, 209, 220, 221, 238 and 254; and C.I. Pigment Violet 19; and C.I. Vat Red 1, 2, 10, 13, 15, 23, 29 and 35.

Examples of dyes include oil-soluble dyes such as C.I. Solvent Red 1, 3, 8, 23, 24, 25, 27, 30, 49, 52, 58, 63, 81, 82, 83, 84, 100, 109, 111, 121 and 122; C.I. Disperse Red 9; C.I. Solvent Violet 8, 13, 14, 21 and 27; and basic dyes such as C.I. Basic Red 1, 2, 9, 12, 13, 14, 15, 17, 18, 22, 23, 24, 27, 29, 32, 34, 35, 36, 37, 38, 39 and 40; and C.I. Basic Violet 1, 3, 7, 10, 14, 15, 21, 25, 26, 27 and 28. The foregoing may be used as a single type, or alternatively two or more types may be used concomitantly.

Preferably, the content of the colorant other than the magnetic body in the toner particle is from 0.5 parts by mass to 20 parts by mass relative to 100 parts by mass of the resin component of the toner particle.

The toner particle may contain a release agent.

Examples of the release agent include:

waxes having a fatty acid ester as a main component, such as carnauba wax and montanate wax;

wholly or partially deacidified products of fatty acid esters such as deacidified carnauba wax;

methyl ester compounds having hydroxyl groups and obtained by hydrogenation of plant-based oils and fats;

saturated fatty acid monoesters such as stearyl stearate and behenyl behenate;

diesterification products of saturated aliphatic dicarboxylic acids and saturated aliphatic alcohols, such as dibehenyl sebacate, distearyl dodecanedioate and distearyl octadecanedioate;

diesterification products of saturated aliphatic diols and saturated fatty acids, such as nonanediol dibehenate and dodecanediol distearate;

aliphatic hydrocarbon waxes such as low molecular weight polyethylene, low molecular weight polypropylene, microcrystalline waxes, paraffin waxes and Fischer Tropsch waxes;

oxides of aliphatic hydrocarbon waxes such as oxidized polyethylene wax, or block copolymers thereof;

waxes resulting from grafting a vinylic monomer such as styrene or acrylic acid to an aliphatic hydrocarbon wax;

saturated linear fatty acids such as palmitic acid, stearic acid and montanic acid;

unsaturated fatty acids such as brassidic acid, eleostearic acid and parinaric acid;

saturated alcohols such as stearyl alcohol, aralkyl alcohol, behenyl alcohol, carnaubyl alcohol, ceryl alcohol and melissyl alcohol;

polyhydric alcohols such as sorbitol;

fatty acid amides such as linoleamide, oleamide and lauramide;

saturated fatty acid bisamides such as methylene bis(stearamide), ethylene bis(capramide), ethylene bis(lauramide) and hexamethylene bis(stearamide);

unsaturated fatty acid amides such as ethylene bis(oleamide), hexamethylene bis(oleamide) and N,N'-dioleyl adipamide and N,N'-dioleyl sebacamide;

aromatic bisamides such as m-xylene bis(stearamide) and N,N'-distearyl isophthalamide;

fatty acid metal salts (ordinarily referred to as metal soaps) such as calcium stearate, calcium laurate, zinc stearate and magnesium stearate; and long-chain alkyl alcohols or long-chain alkyl carboxylic acids having 12 or more carbon atoms.

Preferred among these releasing agents is a monofunctional or bifunctional ester wax such as a monoester or diesterification product of a saturated fatty acid, or hydrocarbon wax such as a paraffin wax or a Fischer Tropsch wax.

The release agent may be used as a single type, or alternatively two or more types may be used concomitantly.

The melting point of the release agent defined by a peak temperature of a maximum endothermic peak at the time of a rise in temperature, and measured using a differential scanning calorimeter (DSC), is preferably from 60° C. to 140° C. The melting point is more preferably from 60° C. to 90° C. The storability of the toner is enhanced when the melting point is 60° C. or higher. In contrast, low-temperature fixability can be readily enhanced when the melting point is 140° C. or lower.

The content of the release agent in the toner particle is preferably from 3 parts by mass to 30 parts by mass with respect to 100 parts by mass of the resin component in the toner particle. Fixing performance improves readily when the content of the release agent is 3 parts by mass or greater. In contrast, the toner is unlikelier to deteriorate after prolonged use, and image stability is readily improved, when the content of the release agent is 30 parts by mass or less.

The toner particle may be used as is as a toner. Various external additives such as inorganic fine particles may also be added to the toner particle to obtain a toner. An organic fine particle may also be used instead of or in addition to an inorganic fine particle.

Examples of inorganic fine particles include lubricants such as silica fine particles, fluorine resin particles, zinc stearate particles and vinylidene polyfluoride particles; and abrasives such as cerium oxide particles, silicon carbide particles, and fine particles of titanate salts of alkali earth metals, specifically strontium titanate fine particles, barium titanate fine particles and calcium titanate fine particles and the like.

A small quantity of a spacer particle such as silica may also be used to the extent that this does not detract from the effects of the invention. Of these, a silica fine particle is desirable because it dramatically improves the flowability of the toner and makes it easier to obtain the effects of the invention.

When a silica fine particle is used, the specific surface area as measured by the BET method using nitrogen adsorption (BET specific surface area) is preferably from 20 $m^2/g$ to 350 $m^2/g$, or more preferably from 25 $m^2/g$ to 300 $m^2/g$ in order to impart good flowability to the toner.

The specific surface area as measured by the BET method using nitrogen adsorption (BET specific surface area) is measured in accordance with JIS Z 8830 (2001). A "automatic specific surface area and pore distribution measurement apparatus TriStar 3000 (Shimadzu Corporation)" can be used as the measurement system for gas adsorption measurement by the constant volume method.

The silica fine particle or other inorganic fine particle is preferably one that has been hydrophobically treated, and especially one that has been hydrophobically treated so as to have a hydrophobicity of at least 40% or more preferably at least 50% as measured by a methanol titration test.

Examples of the method of hydrophobic treatment include methods of treatment with an organic silicon compound, silicone oil, long-chain fatty acid or the like.

Examples of the organic silicon compound include hexamethyl disilazane, trimethyl silane, trimethyl ethoxysilane, isobutyl trimethoxysilane, trimethyl chlorosilane, dimethyl dichlorosilane, methyl trichlorosilane, dimethyl ethoxysilane, dimethyl dimethoxysilane, diphenyl diethoxysilane, hexamethyl disiloxane and the like. One of these organic silicon compounds or a mixture of two or more kinds may be used.

Examples of the silicon oil include dimethyl silicone oil, methyl phenyl silicone oil, α-methyl styrene modified silicone oil, chlorphenyl silicone oil, fluorine modified silicone oil and the like.

A $C_{10-22}$ fatty acid may be used favorably as the long-chain fatty acid, and either a linear or branched fatty acid may be used. Moreover, either a saturated or unsaturated fatty acid may be used.

Of these, a $C_{10-22}$ linear saturated fatty acid is extremely desirable to facilitate uniform treatment of the surface of the inorganic fine particle.

Examples of linear saturated fatty acids include capric acid, lauric acid, myristic acid, palmitic acid, stearic acid, arachidic acid, behenic acid and the like.

Of the inorganic fine particles, a silica fine particle is preferably one that has been treated with silicone oil, and a silica fine particle that has been treated with an organic silicon compound and silicone oil is more preferred because it allows the hydrophobicity to be easily controlled.

Methods for treating the silica fine particle with the silicone oil include a method of using a mixer such as a Henschel mixer to directly mix a silicone oil with a silica fine particle that has already been treated with an organic silicon compound, and a method of spraying the silica fine particle with the silicone oil. Another method is to dissolve or disperse the silicon oil in a suitable solvent, add and mix the silica fine particle, and then remove the solvent.

The amount of the silicon oil used in treatment is preferably from 1 mass part to 40 mass parts, or more preferably from 3 mass parts to 35 mass parts per 100 mass parts of the silica fine particle in order to obtain good hydrophobicity.

The methods for measuring the physical properties are explained next.

Method for Analyzing Monomers of Resin Component such as Amorphous Polyester and Crystalline Polyester (Isolating Resin Component and Release Agent from Toner The toner is dissolved in tetrahydrofuran (THF), and the solvent is distilled off under reduced pressure from the resulting soluble matter to obtain the tetrahydrofuran (THF)-soluble component of the toner. The resulting tetrahydrofuran (THF)-soluble component of the toner is dissolved in chloroform to prepare a sample solution with a concentration of 25 mg/mL. 3.5 mL of the resulting sample solution is injected into the following apparatus, and a low-molecular-weight component derived from a release agent with a molecular weight of less than 2000 and a high-molecular-weight component derived from a resin component with a molecular weight of 2000 or more are separated out under the following conditions.

Preparatory GPC apparatus: Preparatory HPLC LC-980, Japan Analytical Industry Co., Ltd.

Preparatory columns: JAIGEL 3H, JAIGEL 5H (Japan Analytical Industry Co., Ltd.)

Eluent: Chloroform

Flow rate: 3.5 mL/min

Once the high-molecular-weight component derived from the resin component has been separated out, the solvent is distilled off under reduced pressure, and the component is further dried for 24 hours under reduced pressure in a 90° C. atmosphere. This operation is repeated until about 100 mg of the resin component have been obtained.

(Isolating Amorphous Polyester and Crystalline Polyester from Resin Component)

500 mL of acetone are added to 100 mg of the resin component obtained by the above operation, which is then completely melted by heating to 70° C., and gradually cooled to 25° C. to recrystallize the crystalline resin. The crystalline resin is suction filtered and separated into a crystalline polyester and a filtrate.

The separated filtrate is gradually added to 500 mL of methanol to re-precipitate the amorphous polyester. The amorphous polyester is then extracted with a suction filter.

The resulting amorphous polyester and crystalline polyester are dried under reduced pressure for 24 hours at 40° C.

(Monomer Analysis of Resin Component Such as Amorphous Polyester and Crystalline Polyester)

Samples of the resin component such as amorphous polyester and crystalline polyester separated from the toner are analyzed with a pyrolysis GC/MS unit under the following conditions to determine the types of monomers in the resin component such as the amorphous polyester and crystalline polyester.

Measurement apparatus: "Voyager" (product name, Thermo Electron Co., Ltd.)

Pyrolysis temperature: 600° C.

Column: HP-1 (15 m×0.25 mm×0.25 μm)

Inlet: 300° C., Split: 20.0

Injection volume: 1.2 mL/min

Temperature increase: 50° C. (4 min)-300° C. (20° C./min)

Depth Profile Measurement of Secondary Ions on Toner Particle Surface by Time-of-flight Secondary Ion Mass Spectrometry TOF-SIMS The depth profiles of ions derived from the resins constituting the toner particle were measured with a TOF-SIMS unit (TRIFT IV) (Ulvac-Phi, Inc.). The conditions are as follows.

(Sample Preparation)

An indium plate is placed on the sample holder, and the toner particles are attached to the indium plate. When the toner particles move on the sample holder, an indium plate may also be placed on the sample holder and coated with carbon paste before the toner particles are fixed. When a fixing aid such as carbon paste or a silicon wafer is used, the background is measured under the same conditions without the toner particle and used for conversion.

(Sputtering Conditions)
Sputter ion type: Argon cluster ion ($(Ar_n)^+$, n=about 2000)
Acceleration voltage: 10 kV
Current value: 8.5 nA
Sputter area: 600×600 $\mu m^2$
Sputter time: 2 sec/cycle
Sputter rate: 1 nm/sec Relating to the above sputter rate, a polymethyl methacrylate resin is sputtered under the above conditions to a film thickness of 300 nm, and the time taken to finish sputtering 300 nm is calculated and used for conversion by standardization.

(Analysis Conditions)
Primary ion species: Gold ion ($Au^+$)
Acceleration voltage: 25 kV
Current value: 2 pA
Analysis area: 200×200 $\mu m^2$
Pixels: 256×256 pixels
Analysis time: 30 sec/cycle
Repetition frequency: 8.2 kHz
Charge neutralization: ON
Secondary ion polarity: Positive
Secondary ion mass range: m/z 0.5 to 1850

Calculating Intensity of Secondary Ions Derived from Resin Component at Depth t (nm) from Toner Particle Surface Calculating Ia(t)

The types of monomers in the amorphous polyester are identified by the above monomer analysis, and one or more peaks in the mass spectrum of the amorphous polyester that are not attributable to other toner materials are selected. The total of these mass spectrum intensities at a depth of t (nm) from the toner particle surface is given as Ia(t).

Calculating Ic(t)

The types of monomers in the crystalline polyester are identified by the above monomer analysis, and one or more peaks in the mass spectrum of the crystalline polyester that are not attributable to other toner materials are selected. The total of these mass spectrum intensities at a depth of t (nm) from the toner particle surface is given as Ic(t).

Calculating Is(t)

The types of monomers in the styrene acrylic resin are identified by the above monomer analysis, and one or more peaks in the mass spectrum of the styrene acrylic resin that are not attributable to other toner materials are selected. This mass spectrum intensity at a depth of t (nm) from the toner particle surface is given as Is(t).

Calculating I(t)

The resin components used in the toner particle are identified by the above monomer analysis, and all mass spectra derived from the resins are selected. The total of the mass spectrum intensities at a depth of t (nm) from the toner particle surface is given as I(t).

(Isolating Toner Particle from Toner)

The above measurements can also be performed using a toner particle that has been isolated from the toner as follows.

160 g of sucrose (Kishida Chemical Co., Ltd.) is added to 100 mL of ion-exchange water and dissolved while boiling the water to prepare a concentrated sucrose solution. 31 g of this concentrated sucrose solution and 6 mL of Contaminon N (10 mass % aqueous solution of a pH 7 neutral detergent for cleaning precision measuring instruments, comprising a nonionic surfactant, an anionic surfactant and an organic builder, manufactured by Wako Pure Chemical Industries, Ltd.) are placed in a 50 mL centrifuge tube. 1.0 g of the toner is added to this, and toner lumps are broken up with a spatula or the like. The centrifuge tube is shaken for 20 minutes at 300 spm (strokes per minute) in a shaker (AS-1N, sold by AS ONE Corporation). After being shaken, the solution is transferred to a 50 mL glass tube for a swing rotor, and separated for 30 minutes at 3,500 rpm in a centrifuge (H-9R, Kokusan Co., Ltd.).

The toner particle and external additive are separated by this operation. Thorough separation of the toner particle and aqueous solution is confirmed visually, and the toner particles separated in the outermost layer are collected with a spatula or the like. The collected toner particles are filtered with a vacuum filter and dried for at shortest 1 hour in a drier to obtain a measurement sample. This operation is performed multiple times to secure the necessary quantity.

<Method for Measuring the Weight-Average Particle Diameter (D4)>

The weight-average particle diameter (D4) of the toner particles is calculated by analyzing measurement data resulting from a measurement, in 25,000 effective measurement channels, using a precision particle size distribution measuring device (product name: Coulter Counter Multisizer 3, by Beckman Coulter, Inc.) relying on a pore electrical resistance method and equipped with a 100 μm aperture tube, and using dedicated software (product name: Beckman Coulter Multisizer 3, Version 3.51", by Beckman Coulter, Inc.) ancillary to the device, for setting measurement conditions and analyzing measurement data.

The aqueous electrolyte solution used in the measurements can be prepared through dissolution of special-grade sodium chloride to a concentration of about 1 mass % in ion-exchanged water; for instance ISOTON II (product name), manufactured by Beckman Coulter, Inc., can be used herein as the aqueous electrolyte solution.

The dedicated software is set up as follows, prior to measurement and analysis.

In the "Screen of Changing Standard Operating Mode (SOM)" of the dedicated software, a Total Count of the Control Mode is set to 50,000 particles, a Number of Runs is set to one, and a Kd value is set to a value obtained using "Standard particles 10.0 μm" (by Beckman Coulter). The "Threshold/Noise Level" measurement button is pressed to thereby automatically set a threshold value and a noise level. Then the current is set to 1600 μA, the gain is set to 2, the electrolyte solution is set to ISOTON II (product name), and flushing of the aperture tube following measurement is ticked.

In the "Screen for Setting Conversion from Pulses to Particle Size" of the dedicated software, the Bin Interval is set to a logarithmic particle diameter, the Particle Diameter Bin is set to 256 particle diameter bins, and the Particle Diameter Range is set to range from 2 μm to 60 μm.

Specific measurement methods are as described below.

(1) Herein about 200 mL of the aqueous electrolyte solution is placed in a 250 mL round-bottomed glass beaker ancillary to Multisizer 3. The beaker is set on a sample stand and is stirred counterclockwise with a stirrer rod at 24 revolutions per second. Dirt and air bubbles are then removed from the aperture tube by way of the "Aperture Flush" function of the dedicated software.

(2) Then, about 30 mL of the aqueous electrolyte solution is placed in a 100 mL flat-bottomed glass beaker. To the solution, about 0.3 mL of a dilution of "Contaminon N" (product name) by FUJIFILM Wako Pure Chemical Corporation, diluted thrice by mass in ion-exchanged water, is added as a dispersing agent. Contaminon N (product name) is a 10 mass % aqueous solution of a pH-7 neutral detergent for precision measuring instruments, made up of a nonionic surfactant, an anionic surfactant and organic builders.

(3) A predetermined amount of ion-exchanged water is placed in a water tank of an ultrasonic disperser (product name: Ultrasonic Dispersion System Tetora 150, by Nikkaki Bios Co., Ltd.), and about 2 mL of the above Contaminon N (product name) are added into the water tank. The Ultrasonic Dispersion System Tetora 150 is an ultrasonic disperser having an electrical output of 120 W and internally equipped with two oscillators that oscillate at a frequency of 50 kHz and are disposed at a phase offset of 180 degrees.

(4) The beaker in (2) is set in a beaker-securing hole of the ultrasonic disperser, which is then operated. The height position of the beaker is adjusted so as to maximize a resonance state at the liquid level of the aqueous electrolyte solution in the beaker.

(5) With the aqueous electrolyte solution in the beaker of (4) being ultrasonically irradiated, about 10 mg of the toner particles are then added little by little to the aqueous electrolyte solution, to be dispersed therein. The ultrasonic dispersion treatment is further continued for 60 seconds. The water temperature of the water tank during ultrasonic dispersion is adjusted as appropriate to lie in the range from 10° C. to 40° C.

(6) The aqueous electrolyte solution in (5) containing the dispersed toner particles is added dropwise, using a pipette, to the round-bottomed beaker of (1) set inside the sample stand, to adjust the measurement concentration to about 5%. A measurement is then performed until the number of measured particles reaches 50000.

(7) Measurement data is analyzed using the dedicated software ancillary to the apparatus, to calculate the weight-average particle diameter (D4). The "Average Size" in the "Analysis/Volume Statistics (arithmetic average)" screen, when Graph/% by Volume is selected in the dedicated software, yields herein the weight-average particle diameter (D4).

Measuring Melting Point Tm of Crystalline Polyester

The peak temperature of the maximum endothermic peak of the crystalline polyester is measured in accordance with ASTM D3418-82 using a differential scanning calorimeter "Q1000" (TA Instruments).

The melting points of indium and zinc are used for temperature correction of the detector, and the heat of fusion of indium for correcting the calorific value.

Specifically, about 1 mg of the crystalline polyester is weighed exactly and placed in an aluminum pan, and using an empty aluminum pan for reference, measurement is performed at a ramp rate of 10° C./min in the temperature range of 30° C. to 200° C. During measurement, the temperature is raised once to 200° C., then lowered to 30° C., and then raised again. The maximum endothermic peak in the DSC curve in the range of 30° C. to 200° C. during this second temperature increase step is given as the maximum endothermic peak of the endothermic curve in DSC measurement of the crystalline polyester.

Measuring Glass Transition Temperature (Tg) of Toner

The glass transition temperature (Tg) is measured using a differential scanning calorimeter "Q1000" (TA Instruments). The melting points of indium and zinc are used for temperature correction of the detector, and the heat of fusion of indium for correcting the calorific value. Specifically, 3 mg of toner is weighed exactly and placed in an aluminum pan, and using an empty aluminum pan for reference, measurement is performed at a ramp rate of 10° C./min in the temperature range of 30° C. to 200° C.

A specific heat change is obtained in the temperature range of 40° C. to 100° C. during this temperature increase step. The glass transition temperature is the temperature at the intersection between the differential heat curve and the line drawn at the midpoint between the baselines before and after the appearance of the specific heat change.

Measuring Acid Value of Crystalline Polyester

The acid value denotes the number of mg of potassium hydroxide necessary for neutralizing the acid contained in 1 g of sample. The acid value of crystalline polyester is measured in accordance with JIS K0070-1992, and specifically in accordance with the following procedure.

(1) Reagent Preparation

Herein 1.0 g of phenolphthalein is dissolved in 90 mL of ethyl alcohol (95 vol %), add ion exchanged water is added up to 100 mL, to yield a phenolphthalein solution.

Then 7 g of special-grade potassium hydroxide is dissolved in 5 mL of water, and ethyl alcohol (95 vol %) is added up to 1 L. In order to avoid contact with carbon dioxide and the like, the resulting solution is placed in an alkali-resistant container and is allowed to stand for 3 days, after which the solution is filtered, to yield a potassium hydroxide solution. The obtained potassium hydroxide solution is stored in an alkali-resistant container. Then 25 mL of 0.1 mol/L hydrochloric acid are placed in an Erlenmeyer flask, several drops of the phenolphthalein solution are added thereto, and titration is performed using the potassium hydroxide solution. The factor of the potassium hydroxide solution is then worked out from the amount of the potassium hydroxide solution required for neutralization. The 0.1 mol/L hydrochloric acid above is prepared in accordance with JIS K8001-1998.

(2) Operation (A) Main Test

Herein a 2.0 g sample of pulverized crystalline polyester is weighed exactly in a 200 mL Erlenmeyer flask, and 100 mL of a mixed solution of toluene/ethanol (2:1) is added, to dissolve the sample over 5 hours. Next, several drops of the phenolphthalein solution as an indicator are added, and titration is performed using the potassium hydroxide solution. The end point of the titration is the point in time at which the light red color of the indicator lasts for about 30 seconds.

(B) Blank Test

Titration is performed in accordance with the same operation as described above, but herein without using a sample (i.e. by using only the mixed solution of toluene/ethanol (2:1)).

(3) The acid value is calculated by substituting the obtained result into the following expression:

$$A=[(C-B)\times f\times 5.61]/S$$

In the expression, A is the acid value (mgKOH/g), B is the addition amount (mL) of potassium hydroxide solution in the blank test, C is the addition amount (mL) of potassium hydroxide solution in the main test, f is the factor of the potassium hydroxide solution, and S is the mass (g) of the sample.

Measuring Molecular Weight Distributions of Amorphous Polyester, Crystalline Polyester and Toner Particle The molecular weight distribution of the THF-soluble matter in the toner, amorphous polyester resin and crystalline polyester resin are measured by gel permeation chromatography (GPC) as follows.

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

Instrument: HLC8120 GPC (detector: RI) (Tosoh Corporation)

Columns: 7-column train of Shodex KF-801, 802, 803, 804, 805, 806, and 807 (Showa Denko K.K.)

Eluent: tetrahydrofuran (THF)

Flow rate: 1.0 mL/minute

Oven temperature: 40.0° C.

Sample injection amount: 0.10 mL

The molecular weight of the sample is determined using a calibration curve constructed using polystyrene resin standards (for example, product name: "TSK Standard Polystyrene F-850, F-450, F-288, F-128, F-80, F-40, F-20, F-10, F-4, F-2, F-1, A-5000, A-2500, A-1000, and A-500", Tosoh Corporation).

Measuring Content of Styrene Acrylic Resin in Resin Component of Toner

To measure the content of the styrene acrylic resin in the resin component of the toner, a sample of the resin component that has been separated from the toner is analyzed under the following conditions by nuclear magnetic resonance spectroscopy ($^1$H-NMR) [400 MHz, $CDCl_3$, room temperature (25° C.)].

Measurement unit: FT NMR unit JNM-EX400 (JEOL Ltd.)

Measurement frequency: 400 MHz

Pulse condition: 5.0 μs

Frequency range: 10500 Hz

Number of integrations: 64

The content of the styrene acrylic resin in the resin component of the toner is calculated on a mass basis from the integral value of the resulting spectrum.

EXAMPLES

The present invention is explained in detail below using examples, but the invention is not limited thereby. Unless otherwise specified, the parts in the following formulations are based on mass.

Manufacturing Example of Crystalline Polyester CPES1

45 mol % of 1,9-nonanediol and 55 mol % of sebacic acid were placed in a reaction tank equipped with a nitrogen introduction pipe, a dewatering pipe, a stirrer and a thermocouple, 1 part of tin dioctylate as a catalyst was added per 100 parts of the total monomers, and the mixture was heated to 140° C. in a nitrogen atmosphere and reacted for 6 hours as the water was distilled off under normal pressure. Next, the temperature was raised to 200° C. at 10° C./hour to react the mixture, which was then further reacted for 2 hours once the temperature had reached 200° C., after which the pressure inside the reaction tank was reduced to not more than 5 kPa and the reaction was continued at 200° C. while monitoring the molecular weight to obtain a crystalline polyester CPES1. The CPES1 had a weight-average molecular weight (Mw) of 39100.

Manufacturing Examples of Crystalline Polyesters CPES2 to CPES11

The monomer composition was changed as shown in Table 1 in the manufacturing example of the crystalline polyester 1 to obtain crystalline polyesters CPES2 to CPES11. The molar ratios of the alcohol and acid monomers were the same as for CPES1.

Manufacturing Example of Crystalline Polyester CPES12

Manufacturing Vinyl Polymer 1

50.0 parts of xylene were heated under nitrogen purging in a reaction vessel equipped with a stirrer, a thermometer, a nitrogen introduction pipe and a depressurization mechanism, and refluxed at a liquid temperature of 140° C. A mixture of 100.0 parts of styrene and 8.0 parts of dimethyl 2,2'-azobis(2-methylpropionate) as a polymerization initiator was dripped into the reaction vessel over the course of 3 hours, and after completion of dripping, the solution was stirred for 3 hours. The xylene and residual styrene were then distilled off at 160° C., 1 hPa to obtain a vinyl polymer 1. The weight-average molecular weight (Mw) of the resulting vinyl polymer as measured by gel permeation chromatography (GPC) was 8000.

100.0 parts of the vinyl polymer 1, 128.0 parts of xylene as an organic solvent and 78.0 parts of 1,14-tetradecanediol were added to a reaction vessel equipped with a stirrer, a thermometer, a nitrogen introduction pipe, a dewatering pipe and a depressurization mechanism. 0.6 parts of titanium (IV) isopropoxide were further added as an esterification catalyst, and the mixture was reacted for 4 hours at 150° C. in a nitrogen atmosphere. 83.3 parts of tetradecandioic acid were then added, and the mixture was reacted for 3 hours at 150° C. and 4 hours at 180° C.

This was then reacted at 180° C., 1 hPa until the desired weight-average molecular weight (Mw) was obtained to obtain CPES12. The physical properties are shown in Table 1.

TABLE 1

| | Alcohol | Acid | Mw | Melting point ° C. | SP1 | Acid value |
|---|---|---|---|---|---|---|
| CPES1 | 1,9-nonanediol | Sebacic acid | 39100 | 70 | 9.63 | 1.4 |
| CPES2 | 1,10-dodecanediol | 1,10-dodecandioic acid | 3200 | 73 | 9.00 | 1.2 |
| CPES3 | 1,10-dodecanediol | 1,10-dodecandioic acid | 1720 | 65 | 8.90 | 0.7 |
| CPES4 | 1,9-nonanediol | Sebacic acid | 13200 | 69 | 9.47 | 0.9 |
| CPES5 | 1,9-nonanediol | 1,10-dodecandioic acid | 12600 | 72 | 9.40 | 0.5 |
| CPES6 | 1,10-dodecanediol | Sebacic acid | 22800 | 76 | 9.51 | 1.9 |
| CPES7 | 1,9-nonanediol | Sebacic acid | 46200 | 70 | 9.64 | 1.9 |
| CPES8 | 1,6-hexanediol | 1,10-dodecandioic acid | 32100 | 70 | 9.71 | 1.3 |
| CPES9 | 1,12-dodecanediol | Sebacic acid | 21300 | 83 | 9.48 | 0.6 |
| CPES10 | 1,6-hexanediol | Sebacic acid | 26000 | 67 | 9.83 | 1.7 |
| CPES11 | 1,10-dodecanediol | Sebacic acid | 20800 | 76 | 9.58 | 1.5 |
| CPES12 | 1,14-tetradecanediol | Tetradecandioic acid | 34000 | 90 | 9.55 | 1.7 |

In the table, the acid value is given in units of mg KOH/g and the SP value in units of $(cal/cm^3)^{1/2}$.

Manufacturing Example of Amorphous Polyester APES1

A carboxylic acid component and alcohol component were prepared as shown in Table 2 as raw material monomers and placed in a reaction tank equipped with a nitrogen introduction pipe, a dewatering pipe, a stirrer and a thermocouple, after which dibutyl tin was added as a catalyst in the amount of 1.5 parts per 100 parts of the total monomers. The temperature was then rapidly raised to 180° C. at normal pressure in a nitrogen atmosphere, and then raised from 180° C. to 210° C. at a rate of 10° C./hour as the water was distilled off to perform polycondensation.

Once 210° C. had been reached the reaction tank was depressurized to not more than 5 kPa, and polycondensation was performed under conditions of 210° C., 5 kPa or less to obtain an amorphous polyester APES1. The polymerization time was adjusted during this process so as to obtain the weight-average molecular weight (Mw) shown in Table 2. The physical properties are shown in Table 2.

Manufacturing Examples of Amorphous Polyesters APES2 to APES7

The monomer composition was changed as shown in Table 2 in the manufacturing example of the amorphous polyester APES1 to obtain amorphous polyesters APES2 to APES7.

Manufacturing Example of Amorphous Polyester APES8

100 parts of a mixture of the raw material monomers other than the trimellitic anhydride in the charged amounts shown in Table 2 and 0.52 parts of tin di(2-ethylhexanoate) were placed in a polymerization tank equipped with a nitrogen introduction line, a dewatering line and a stirrer. A nitrogen atmosphere was substituted inside the polymerization tank, after which heating was performed at 200° C. as a polycondensation reaction was performed for 6 hours. The temperature was then raised to 210° C., the trimellitic anhydride was added, and the polymerization tank was depressurized to 40 kPa, after which a further condensation reaction was performed to obtain APES8.

Manufacturing Example of Amorphous Polyester APES9

The raw material monomers were added as shown in Table 2 to a reaction tank equipped with a nitrogen introduction pipe, a dewatering pipe, a stirrer and a thermocouple. Nitrogen gas was then substituted inside the reaction tank, after which the temperature was gradually raised under stirring, and stirring was continued at 200° C. as the mixture was reacted for 4 hours. The pressure inside the reaction tank was lowered to 8.3 kPa and maintained for 1 hour, after which the mixture was cooled to 160° C. and returned to atmospheric pressure. Tert-butyl catechol (reaction inhibitor) was then added in the amount of 0.1 part per 100 parts of the total monomers, the pressure inside the reaction tank was reduced to 8.3 kPa, the temperature was maintained at 180° C. as the mixture was reacted for 1 hour, and once the softening point was confirmed to have reached 90° C., the temperature was lowered to stop the reaction and obtain an amorphous polyester APES9.

Manufacturing Example of Amorphous Polyester APES 10

An amorphous polyester APES10 was obtained by changing the monomer composition as shown in Table 2 in the manufacturing example of the amorphous polyester APES9.

TABLE 2

| | Alcohol component (mol parts) | | | | Carboxylic acid component (mol parts) | | | | | |
|---|---|---|---|---|---|---|---|---|---|---|
| | Bisphenol A PO-adduct | Moles of added PO | Ethylene glycol | Isosorbide | Terephthalic acid | Isophthalic acid | Trimellitic acid | Succinic acid | Mw | SP2 |
| APES1 | 100 | 4.0 | | | 96.25 | | 3.75 | | 13000 | 12.68 |
| APES2 | 100 | 2.0 | | | 100 | | 0.01 | | 10000 | 12.55 |
| APES3 | 100 | 2.0 | | | 88.89 | | 11.11 | | 10000 | 12.94 |
| APES4 | 100 | 3.0 | | | 50 | 50 | | | 9800 | 12.53 |
| APES5 | 100 | 1.0 | | | 50 | 50 | | | 10000 | 12.81 |
| APES6 | 100 | 5.0 | | | 50 | 50 | | | 17000 | 12.74 |
| APES7 | 100 | 6.0 | | | 50 | 50 | | | 25000 | 12.73 |
| APES8 | 59.44 | 2.0 | 35.7 | 5.0 | 95.56 | | 4.4 | | 9500 | 13.43 |
| APES9 | 100 | 2.0 | | | 60 | | | 40 | 9500 | 12.43 |
| APES10 | 100 | 2.5 | | | 60 | | | 40 | 9500 | 12.33 |

PO represents propylene oxide.

<Production Example of a Treated Magnetic Body>

In an aqueous solution of ferrous sulfate, from 1.00 to 1.10 equivalents of a sodium hydroxide solution, relative to iron atoms, $P_2O_5$ in an amount of 0.15 mass % on phosphorus atom basis relative to iron atoms, and $SiO_2$ in an amount of 0.50 mass % on silicon atom basis relative to iron atoms were mixed. Thereafter, an aqueous solution containing ferrous hydroxide was prepared. The pH of this aqueous solution was adjusted to 8.0, and an oxidation reaction was carried out at 85° C. while air was blown in, to prepare a slurry liquid having seed crystals.

Next, an aqueous solution of ferrous sulfate was added to the slurry liquid, in an amount from 0.90 to 1.20 equivalents relative to the initial alkali amount (sodium component of sodium hydroxide). Thereafter, the slurry liquid was maintained at pH 7.6, and an oxidation reaction was let to proceed while air was blown in, to prepare a slurry liquid containing a magnetic iron oxide.

The obtained slurry liquid was filtered, was washed, and thereafter the water-containing slurry was retrieved temporarily. At this time a small amount of the water-containing slurry was sampled, and the water content was measured.

Next, this water-containing slurry was placed in another aqueous medium, without drying, and was re-dispersed in a pin mill, while the slurry was stirred and caused to circulate, and the pH of the re-dispersed solution was adjusted to about 4.8.

Then 1.6 parts of a n-hexyltrimethoxysilane coupling agent were added, while under stirring, to 100 parts of magnetic iron oxide (the amount of magnetic iron oxide was calculated by subtracting the water content from the water-containing slurry) to elicit hydrolysis. This was followed by a surface treatment through stirring, and with the pH of the dispersion set to 8.6. The generated hydrophobic magnetic body was filtered using a filter press, was washed with a large amount of water, was then dried for 15 minutes at 100° C., and was then dried at 90° C. for 30 minutes. Thereafter, the obtained particles were subjected to a deagglomeration treatment, to yield a treated magnetic body having a volume-average particle diameter of 0.21 μm.

Manufacturing Example of Toner Particle 1

450 parts of a 0.1 mol/L $Na_3PO_4$ aqueous solution were added to 720 parts of ion-exchange water and heated to 60° C., after which 67.7 parts of 1.0 mol/L $CaCl_2$ aqueous solution were added to obtain an aqueous medium containing a dispersant.

| | |
|---|---|
| Styrene | 74.0 parts |
| n-butyl acrylate | 26.0 parts |
| APES1 | 4.0 parts |
| Treated magnetic body | 65.0 parts |

These materials were uniformly dispersed and mixed with an attritor (Mitsui Miike Kakoki Corporation) to obtain a polymerizable monomer composition. This polymerizable monomer composition was heated to 63° C., and 15.0 parts of paraffin wax (HNP-51, Nippon Seiro Co., Ltd., melting point 74° C.) and 15 parts of CPES1 were added, mixed and dissolved. 7.0 parts of the polymerization initiator tert-butyl peroxypivalate were then dissolved therein.

This polymerizable monomer composition was then added to the above aqueous medium and stirred for 10 minutes at 12000 rpm with a T.K. Homomixer (Tokushu Kika Kogyo Co., Ltd.) in a nitrogen atmosphere at 60° C. to form (granulate) particles.

This was then stirred with a paddle stirring blade while being reacted for 4 hours at 74° C.

Next, the temperature of the aqueous medium was raised to 100° C. and maintained for 120 minutes. This was then cooled to room temperature at a rate of 3° C. per minute, hydrochloric acid was added to dissolve the dispersant, and the mixture was filtered, water washed and dried to obtain a toner particle 1 with a weight-average particle diameter (D4) of 6.7 μm.

The manufacturing conditions for the resulting toner particle 1 are shown in Table 3.

Manufacturing Examples of Toner Particles 2 to 15, 17 and 18 and Comparative Toner Particles 1 to 6, 9 and 10

Toner particles 2 to 15, 17 and 18 and comparative toner particles 1 to 6, 9 and 10 were manufactured as in the manufacturing example of the toner particle 1 except that the amorphous polyester and crystalline polyester were changed. The manufacturing conditions and physical properties are shown in Table 3.

Manufacturing Example of Toner Particle 16

| | |
|---|---|
| Release agent (paraffin wax) (HNP-51: Nippon Seiro Co., Ltd., melting point 74° C.) | 10.0 parts |
| Carbon black (Nipex35: Orion Engineered Carbons) | 5.0 parts |
| CPES1 | 60.0 parts |
| APES1 | 20.0 parts |
| Toluene (SP value 8.8) | 150.0 parts |

The above solution was placed in a container and stirred and dispersed for 5 minutes at 2000 rpm with a Homo Disper (Tokushu Kika Kogyo Co., Ltd.) to prepare an oil phase.

390.0 parts of 0.1 mol/L sodium phosphate ($Na_3PO_4$) aqueous solution were added to 1152.0 parts of ion-exchange water in a separate container, and stirred with a Clearmix (M Technique Co., Ltd.) while being heated to 70° C. 58.0 parts of 1.0 mol/L calcium chloride ($CaCl_2$) aqueous solution were then added and stirring was continued to manufacture a dispersion stabilizer comprising calcium triphosphate ($Ca_3(PO_4)_2$) and prepare an aqueous medium.

The oil phase was then added to the water phase, and granulation was performed by stirring for 10 minutes at 10000 rpm, 60° C. in a nitrogen atmosphere with a Clearmix (M Technique Co., Ltd.). The resulting suspension was then stirred at a rotational speed of 150 rpm with a paddle stirring blade as the solvent was removed over the course of 5 hours at 80° C. under reduced pressure of 400 mbar. The suspension was then cooled to 25° C., and ion-exchange water was added to adjust the solids concentration of the dispersion to 20 mass % and obtain a toner slurry 1.

This toner slurry 1 was cooled to 25° C. hydrochloric acid was added to a pH of 1.5, and the slurry was stirred for 2 hours. This was then filtered, water washed and dried to obtain a toner particle 16.

Manufacturing Example of Comparative Toner Particle 7

Preparation of Crystalline Polyester Dispersion 1

100.0 parts of CPES1, 90.0 parts of toluene and 2.0 parts of diethyl amino ethanol were loaded into a reaction vessel equipped with a stirrer, a condenser, a thermometer and a nitrogen introduction pipe, and heated to 80° C. to dissolve the mixture. 300.0 parts of ion-exchange water were then added gradually under stiffing at 80° C. to perform phase inversion emulsification, and the resulting aqueous dispersion was transferred to a distillation apparatus and distilled until the distillate temperature was 100° C. After cooling, ion-exchange water was added to the resulting aqueous dispersion to adjust the resin concentration of the dispersion to 20%. This was taken as the crystalline polyester dispersion 1.

Preparation of Amorphous Polyester Dispersion 1

100.0 parts of APES1, 90.0 parts of toluene and 2.0 parts of diethyl amino ethanol were loaded into a reaction vessel equipped with a stirrer, a condenser, a thermometer and a nitrogen introduction pipe, and heated to 80° C. to dissolve the mixture. 300.0 parts of ion-exchange water were then added gradually under stirring at 80° C. to perform phase inversion emulsification, and the resulting aqueous dispersion was transferred to a distillation apparatus and distilled until the distillate temperature was 100° C. After cooling, ion-exchange water was added to the resulting aqueous dispersion to adjust the resin concentration of the dispersion to 20%. This was taken as amorphous polyester dispersion 1.

Preparation of Colorant Dispersion

| | |
|---|---|
| Carbon black (Nipex35: Orion Engineered Carbons) | 70.0 parts |
| Anionic surfactant (product name: Neogen SC, DKS Co., Ltd.) | 3.0 parts |
| Ion-exchange water | 400.0 parts |

These components were mixed and dissolved, and then dispersed with a homogenizer (IKA, Ultra-Turrax) to obtain a colorant dispersion.

Preparation of Release Agent Dispersion

| | |
|---|---|
| Paraffin wax (HNP-51: Nippon Seiro Co., Ltd., melting point 74° C.) | 100.0 parts |
| Anionic surfactant (product name: Pionin A-45-D, Takemoto Oil & Fat Co., Ltd.) | 2.0 parts |
| Ion-exchange water | 500.0 parts |

These components were mixed and dissolved, dispersed with a homogenizer (IKA, Ultra-Turrax), and then dispersed with a pressure discharge type Gorin homogenizer to obtain a release agent dispersion comprising a dispersed release agent fine particle (paraffin wax).

| | |
|---|---|
| Crystalline polyester dispersion 1 | 180.0 parts |
| Amorphous polyester dispersion 1 | 60.0 parts |
| Colorant dispersion | 50.0 parts |
| Release agent dispersion | 60.0 parts |
| Cationic surfactant (product name: Sanisol B50, Kao Corporation) | 3.0 parts |
| Ion-exchange water | 500.0 parts |

These components were mixed and dispersed in a round-bottomed stainless-steel flask with a homogenizer (product name: Ultra-Turrax T50, IKA) to prepare a liquid mixture, and then heated to 50° C. under stirring in a heating oil bath and maintained at 50° C. for 30 minutes to form aggregate particles. 60.0 parts of the crystalline polyester dispersion 1 and 6.0 parts of an anionic surfactant (product name: Neogen SC, DKS Co., Ltd.) were then added to the dispersion with the dispersed aggregate particles, which was then heated to 65° C. A suitable amount of sodium hydroxide was then added to adjust the system to a pH of 7.0, and the mixture was maintained as is for 3 hours to fuse the aggregate particles. This was then cooled to 25° C., and ion-exchange water was added to adjust the solids concentration of the dispersion to 20 mass % and obtain a toner slurry 2.

This was then thoroughly washed with ion-exchange water, and then filtered, dried and classified to obtain a comparative toner particle 7.

Manufacturing Example of Comparative Toner Particle 8

A comparative toner particle 8 was obtained as in the manufacturing example of the comparative toner particle 7 except that CPES8 was used instead of CPES1 and APES8 instead of APES1.

TABLE 3

| | Amorphous polyester | | Crystalline polyester | | Styrene | | | |
|---|---|---|---|---|---|---|---|---|
| Toner particle No. | Type | Added amount (parts) | Type | Added amount (parts) | acrylic resin content | SP2 - SP1 | D4 μm | Tg ° C. |
| 1 | APES1 | 4.0 | CPES1 | 15.0 | 84 | 3.05 | 6.7 | 52 |
| 2 | APES1 | 4.0 | CPES2 | 15.0 | 84 | 3.68 | 6.5 | 47 |
| 3 | APES1 | 4.0 | CPES4 | 15.0 | 84 | 3.21 | 6.6 | 49 |
| 4 | APES1 | 4.0 | CPES6 | 15.0 | 84 | 3.17 | 6.8 | 51 |
| 5 | APES5 | 4.0 | CPES7 | 15.0 | 84 | 3.17 | 9.7 | 55 |
| 6 | APES2 | 4.0 | CPES5 | 15.0 | 84 | 3.15 | 6.8 | 51 |
| 7 | APES4 | 4.0 | CPES9 | 15.0 | 84 | 3.05 | 6.7 | 51 |
| 8 | APES6 | 4.0 | CPES1 | 15.0 | 84 | 3.11 | 6.8 | 53 |
| 9 | APES7 | 4.0 | CPES5 | 15.0 | 84 | 3.33 | 6.6 | 49 |
| 10 | APES9 | 4.0 | CPES5 | 15.0 | 84 | 3.03 | 6.7 | 56 |
| 11 | APES5 | 4.0 | CPES4 | 15.0 | 84 | 3.34 | 6.7 | 48 |
| 12 | APES3 | 4.0 | CPES5 | 15.0 | 84 | 3.54 | 6.9 | 53 |
| 13 | APES8 | 4.0 | CPES10 | 15.0 | 84 | 3.57 | 6.8 | 54 |
| 14 | APES3 | 4.0 | CPES11 | 15.0 | 84 | 3.36 | 6.8 | 53 |
| 15 | APES8 | 4.0 | CPES8 | 15.0 | 84 | 3.69 | 6.7 | 54 |
| 16 | APES1 | 20.0 | CPES1 | 60 | 0 | 3.05 | 6.8 | 54 |
| 17 | APES2 | 2.0 | CPES4 | 7.0 | 92 | 3.08 | 6.8 | 52 |
| 18 | APES2 | 4.0 | CPES7 | 15.0 | 84 | 2.91 | 6.9 | 55 |
| C. 1 | APES4 | 4.0 | CPES1 | 15.0 | 84 | 2.9 | 9.3 | 46 |
| C. 2 | APES8 | 4.0 | CPES1 | 15.0 | 84 | 3.78 | 6.7 | 58 |
| C. 3 | — | — | CPES1 | 15.0 | 77 | — | 8.6 | 50 |
| C. 4 | APES1 | 4.0 | CPES3 | 15.0 | 84 | 3.78 | 6.9 | 45 |
| C. 5 | APES10 | 4.0 | CPES5 | 15.0 | 84 | 2.93 | 6.8 | 48 |
| C. 6 | APES8 | 4.0 | CPES12 | 15.0 | 84 | 3.85 | 6.8 | 49 |
| C. 7 | APES1 | 60.0 | CPES1 | 180.0 | 0 | 3.05 | 6.8 | 54 |
| C. 8 | APES8 | 60.0 | CPES8 | 180.0 | 0 | 3.69 | 6.8 | 55 |
| C. 9 | APES2 | 2.0 | CPES4 | 3.0 | 95 | 3.08 | 6.7 | 53 |
| C. 10 | APES3 | 15.0 | CPES5 | 7.0 | 82 | 3.54 | 6.8 | 52 |

In the table, "C." denotes comparative. The added amounts of the amorphous polyester and crystalline polyester are amounts per 100 parts of the polymerizable monomers. The content of the styrene acrylic monomer is given as mass %.

Manufacturing Example of Toner 1

Using a Mitsui Henschel Mixer (Mitsui Miike Kakoki Corporation), a toner 1 was prepared by mixing 100 parts of the toner particle 1 with 1.2 parts of a treated hydrophobic silica fine particle with a treated BET specific surface area of 120 $m^2/g$ obtained by treating silica with a primary particle diameter of 12 nm with hexamethyl disilazane and then with silicone oil. The physical properties are shown in Tables 4-1, 4-2 and 4-3.

Manufacturing Examples of Toners 2 to 18 and Comparative Toners 1 to 10

Toners 2 to 18 and comparative toners 1 to 10 were obtained by changing the toner particles as shown in Tables 4-1, 4-2 and 4-3 in the manufacturing example of the toner 1. The physical properties are shown in the Tables 4-1, 4-2 and 4-3.

TABLE 4-1

| Value | Range | Toner 1 Toner particle 1 | Toner 2 Toner particle 2 | Toner 3 Toner particle 3 | Toner 4 Toner particle 4 | Toner 5 Toner particle 5 | Toner 6 Toner particle 6 |
|---|---|---|---|---|---|---|---|
| la(t) | t = 0 | 0.0430 | 0.0385 | 0.0410 | 0.0415 | 0.0455 | 0.0405 |
| | t = 10 | 0.0377 | 0.0330 | 0.0350 | 0.0355 | 0.0389 | 0.0348 |
| | t = 30 | 0.0171 | 0.0149 | 0.0158 | 0.0165 | 0.0182 | 0.0153 |
| | t = 60 | 0.0063 | 0.0062 | 0.0064 | 0.0066 | 0.0061 | 0.0063 |
| lc(t) | t = 0 | 0.0177 | 0.0255 | 0.0230 | 0.0191 | 0.0122 | 0.0233 |
| | t = 10 | 0.0263 | 0.0305 | 0.0295 | 0.0283 | 0.0255 | 0.0298 |
| | t = 30 | 0.0239 | 0.0262 | 0.0255 | 0.0252 | 0.0240 | 0.0250 |
| | t = 60 | 0.0150 | 0.0148 | 0.0152 | 0.0153 | 0.0147 | 0.0150 |
| ls(t) | t = 0 | 0.0063 | 0.0065 | 0.0066 | 0.0062 | 0.0062 | 0.0063 |
| | t = 10 | 0.0072 | 0.0071 | 0.0072 | 0.0075 | 0.0070 | 0.0072 |
| | t = 30 | 0.0135 | 0.0133 | 0.0137 | 0.0139 | 0.0131 | 0.0135 |
| | t = 60 | 0.0154 | 0.0158 | 0.0152 | 0.0155 | 0.0157 | 0.0160 |
| l(t) | t = 0 | 0.0670 | 0.0705 | 0.0706 | 0.0668 | 0.0639 | 0.0701 |
| | t = 10 | 0.0712 | 0.0706 | 0.0717 | 0.0713 | 0.0714 | 0.0718 |
| | t = 30 | 0.0545 | 0.0544 | 0.0550 | 0.0556 | 0.0553 | 0.0538 |
| | t = 60 | 0.0367 | 0.0368 | 0.0368 | 0.0374 | 0.0365 | 0.0373 |
| la(t) + lc(t)/l(t) | t = 0 | 0.91 | 0.91 | 0.91 | 0.91 | 0.90 | 0.91 |
| | t = 10 | 0.90 | 0.90 | 0.90 | 0.89 | 0.90 | 0.90 |
| Position of intersection between la(t) and lc(t) | | 17 | 12 | 14 | 14 | 18 | 13 |
| lc(t)/l(t) | t = 0 | 0.26 | 0.36 | 0.33 | 0.29 | 0.19 | 0.33 |
| | t = 30 | 0.44 | 0.48 | 0.46 | 0.45 | 0.43 | 0.46 |
| ls(t)/l(t) | t = 30 | 0.25 | 0.24 | 0.25 | 0.25 | 0.24 | 0.25 |
| | t = 60 | 0.42 | 0.43 | 0.41 | 0.41 | 0.43 | 0.43 |

| Value | Range | Toner 7 Toner particle 7 | Toner 8 Toner particle 8 | Toner 9 Toner particle 9 | Toner 10 Toner particle 10 | Toner 11 Toner particle 11 | Toner 12 Toner particle 12 |
|---|---|---|---|---|---|---|---|
| la(t) | t = 0 | 0.0425 | 0.0465 | 0.0458 | 0.0379 | 0.0412 | 0.0431 |
| | t = 10 | 0.0395 | 0.0392 | 0.0392 | 0.0332 | 0.0352 | 0.0375 |
| | t = 30 | 0.0188 | 0.0180 | 0.0181 | 0.0145 | 0.0161 | 0.0179 |
| | t = 60 | 0.0062 | 0.0065 | 0.0067 | 0.0064 | 0.0069 | 0.0063 |
| lc(t) | t = 0 | 0.0185 | 0.0165 | 0.0115 | 0.0277 | 0.0205 | 0.0142 |
| | t = 10 | 0.0277 | 0.0280 | 0.0265 | 0.0312 | 0.0285 | 0.0273 |
| | t = 30 | 0.0255 | 0.0241 | 0.0223 | 0.0298 | 0.0251 | 0.0238 |
| | t = 60 | 0.0155 | 0.0153 | 0.0140 | 0.0153 | 0.0155 | 0.0153 |
| ls(t) | t = 0 | 0.0064 | 0.0063 | 0.0063 | 0.0066 | 0.0062 | 0.0063 |
| | t = 10 | 0.0072 | 0.0075 | 0.0071 | 0.0073 | 0.0075 | 0.0076 |
| | t = 30 | 0.0133 | 0.0135 | 0.0134 | 0.0133 | 0.0138 | 0.0136 |
| | t = 60 | 0.0159 | 0.0154 | 0.0153 | 0.0161 | 0.0158 | 0.0151 |
| l(t) | t = 0 | 0.0674 | 0.0693 | 0.0636 | 0.0722 | 0.0679 | 0.0636 |
| | t = 10 | 0.0744 | 0.0747 | 0.0728 | 0.0717 | 0.0712 | 0.0724 |
| | t = 30 | 0.0576 | 0.0556 | 0.0538 | 0.0576 | 0.0550 | 0.0553 |
| | t = 60 | 0.0376 | 0.0372 | 0.0360 | 0.0378 | 0.0382 | 0.0367 |
| la(t) + lc(t)/l(t) | t = 0 | 0.91 | 0.91 | 0.90 | 0.91 | 0.91 | 0.90 |
| | t = 10 | 0.90 | 0.90 | 0.90 | 0.90 | 0.89 | 0.90 |
| Position of intersection between la(t) and lc(t) | | 17 | 17 | 18 | 12 | 14 | 16 |
| lc(t)/l(t) | t = 0 | 0.27 | 0.24 | 0.18 | 0.38 | 0.30 | 0.22 |
| | t = 30 | 0.44 | 0.43 | 0.41 | 0.52 | 0.46 | 0.43 |
| ls(t)/l(t) | t = 30 | 0.23 | 0.24 | 0.25 | 0.23 | 0.25 | 0.25 |
| | t = 60 | 0.42 | 0.41 | 0.43 | 0.43 | 0.41 | 0.41 |

TABLE 4-2

| Value | Range | Toner 13 Toner particle 13 | Toner 14 Toner particle 14 | Toner 15 Toner particle 15 | Toner 16 Toner particle 16 | Toner 17 Toner particle 17 | Toner 18 Toner particle 18 |
|---|---|---|---|---|---|---|---|
| la(t) | t = 0 | 0.0435 | 0.0416 | 0.0440 | 0.0441 | 0.0348 | 0.0417 |
| | t = 10 | 0.0378 | 0.0358 | 0.0381 | 0.0382 | 0.0276 | 0.0372 |
| | t = 30 | 0.0174 | 0.0160 | 0.0176 | 0.0180 | 0.0211 | 0.0132 |
| | t = 60 | 0.0063 | 0.0063 | 0.0063 | 0.0063 | 0.015 | 0.0066 |
| lc(t) | t = 0 | 0.0132 | 0.0192 | 0.0129 | 0.0183 | 0.0105 | 0.0289 |
| | t = 10 | 0.0268 | 0.0280 | 0.0269 | 0.0269 | 0.0195 | 0.036 |
| | t = 30 | 0.0237 | 0.0249 | 0.0235 | 0.0243 | 0.0233 | 0.0302 |
| | t = 60 | 0.0152 | 0.0153 | 0.0150 | 0.0150 | 0.0063 | 0.0155 |
| ls(t) | t = 0 | 0.0062 | 0.0063 | 0.0063 | 0.0000 | 0.0095 | 0.0063 |
| | t = 10 | 0.0071 | 0.0078 | 0.0079 | 0.0000 | 0.0105 | 0.0071 |
| | t = 30 | 0.0137 | 0.0135 | 0.0135 | 0.0000 | 0.0206 | 0.0135 |
| | t = 60 | 0.0162 | 0.0159 | 0.0153 | 0.0000 | 0.0255 | 0.0154 |

TABLE 4-2-continued

| Value | Range | Toner 13 Toner particle 13 | Toner 14 Toner particle 14 | Toner 15 Toner particle 15 | Toner 16 Toner particle 16 | Toner 17 Toner particle 17 | Toner 18 Toner particle 18 |
|---|---|---|---|---|---|---|---|
| l(t) | t = 0 | 0.0629 | 0.0671 | 0.0632 | 0.0624 | 0.0548 | 0.0769 |
| | t = 10 | 0.0717 | 0.0716 | 0.0729 | 0.0651 | 0.0576 | 0.0803 |
| | t = 30 | 0.0548 | 0.0544 | 0.0546 | 0.0423 | 0.065 | 0.0569 |
| | t = 60 | 0.0377 | 0.0375 | 0.0366 | 0.0213 | 0.0468 | 0.0375 |
| la(t) + lc(t)/l(t) | t = 0 | 0.90 | 0.91 | 0.90 | 1.00 | 0.83 | 0.92 |
| | t = 10 | 0.90 | 0.89 | 0.89 | 1.00 | 0.82 | 0.91 |
| Position of intersection between la(t) and lc(t) | | 16 | 15 | 17 | 16 | 22 | 12 |
| lc(t)/l(t) | t = 0 | 0.21 | 0.29 | 0.20 | 0.29 | 0.19 | 0.38 |
| | t = 30 | 0.43 | 0.46 | 0.43 | 0.57 | 0.36 | 0.53 |
| ls(t)/l(t) | t = 30 | 0.25 | 0.25 | 0.25 | 0.00 | 0.32 | 0.24 |
| | t = 60 | 0.43 | 0.42 | 0.42 | 0.00 | 0.54 | 0.41 |

TABLE 4-3

| Value | Range | C. toner 1 C. toner particle 1 | C. toner 2 C. toner particle 2 | C. toner 3 C. toner particle 3 | C. toner 4 C. toner particle 4 | C. toner 5 C. toner particle 5 | C. toner 6 C. toner particle 6 |
|---|---|---|---|---|---|---|---|
| la(t) | t = 0 | 0.0410 | 0.0859 | 0.0004 | 0.0450 | 0.0410 | 0.0859 |
| | t = 10 | 0.0389 | 0.0752 | 0.0003 | 0.0392 | 0.0389 | 0.0752 |
| | t = 30 | 0.0218 | 0.0452 | 0.0002 | 0.0209 | 0.0218 | 0.0452 |
| | t = 60 | 0.0102 | 0.0285 | 0.0003 | 0.0112 | 0.0102 | 0.0285 |
| lc(t) | t = 0 | 0.0569 | 0.0058 | 0.0836 | 0.0548 | 0.0552 | 0.0058 |
| | t = 10 | 0.0377 | 0.0073 | 0.0809 | 0.0382 | 0.0380 | 0.0073 |
| | t = 30 | 0.0224 | 0.0095 | 0.0504 | 0.0252 | 0.0234 | 0.0095 |
| | t = 60 | 0.0157 | 0.0150 | 0.0187 | 0.0158 | 0.0156 | 0.0150 |
| ls(t) | t = 0 | 0.0048 | 0.0063 | 0.0099 | 0.0047 | 0.0045 | 0.0063 |
| | t = 10 | 0.0068 | 0.0085 | 0.0076 | 0.0065 | 0.0065 | 0.0085 |
| | t = 30 | 0.0146 | 0.0182 | 0.0120 | 0.0147 | 0.0146 | 0.0182 |
| | t = 60 | 0.0184 | 0.0252 | 0.0141 | 0.0185 | 0.0183 | 0.0252 |
| Kt) | t = 0 | 0.1027 | 0.0980 | 0.0939 | 0.1045 | 0.1007 | 0.0980 |
| | t = 10 | 0.0834 | 0.0910 | 0.0888 | 0.0839 | 0.0834 | 0.0910 |
| | t = 30 | 0.0588 | 0.0729 | 0.0626 | 0.0608 | 0.0598 | 0.0729 |
| | t = 60 | 0.0443 | 0.0687 | 0.0331 | 0.0455 | 0.0441 | 0.0687 |
| la(t)+lc(t)/l(t) | t = 0 | 0.95 | 0.94 | 0.89 | 0.96 | 0.96 | 0.94 |
| | t = 10 | 0.92 | 0.91 | 0.91 | 0.92 | 0.92 | 0.91 |
| Position of intersection between la(t) and lc(t) | | 8 | None | None | 7 | 8 | None |
| lc(t)/l(t) | t = 0 | 0.55 | 0.06 | 0.89 | 0.52 | 0.55 | 0.06 |
| | t = 30 | 0.38 | 0.13 | 0.81 | 0.41 | 0.39 | 0.13 |
| ls(t)/l(t) | t = 30 | 0.25 | 0.25 | 0.19 | 0.24 | 0.24 | 0.25 |
| | t = 60 | 0.42 | 0.37 | 0.43 | 0.41 | 0.41 | 0.37 |

| Value | Range | C. toner 7 C. toner particle 7 | C. toner 8 C. toner particle 8 | C. toner 9 C. toner particle 9 | C. toner 10 C. toner particle 10 |
|---|---|---|---|---|---|
| la(t) | t = 0 | 0.0853 | 0.0859 | 0.0332 | 0.0855 |
| | t = 10 | 0.0848 | 0.0856 | 0.0259 | 0.0762 |
| | t = 30 | 0.0847 | 0.0855 | 0.0198 | 0.0465 |
| | t = 60 | 0.0023 | 0.0021 | 0.0122 | 0.0352 |
| lc(t) | t = 0 | 0.0023 | 0.0022 | 0.0089 | 0.0066 |
| | t = 10 | 0.0025 | 0.0023 | 0.0155 | 0.0082 |
| | t = 30 | 0.0025 | 0.0023 | 0.0203 | 0.0122 |
| | t = 60 | 0.0733 | 0.0745 | 0.0066 | 0.015 |
| ls(t) | t = 0 | 0.0000 | 0.0000 | 0.0095 | 0.0063 |
| | t = 10 | 0.0000 | 0.0000 | 0.0124 | 0.0085 |
| | t = 30 | 0.0000 | 0.0000 | 0.0229 | 0.0182 |
| | t = 60 | 0.0000 | 0.0000 | 0.0273 | 0.0252 |
| l(t) | t = 0 | 0.0876 | 0.0881 | 0.0516 | 0.0984 |
| | t = 10 | 0.0873 | 0.0879 | 0.0538 | 0.0929 |
| | t = 30 | 0.0872 | 0.0878 | 0.063 | 0.0769 |
| | t = 60 | 0.0756 | 0.0766 | 0.0461 | 0.0754 |
| la(t) + lc(t)/l(t) | t = 0 | 1.00 | 1.00 | 0.82 | 0.94 |
| | t = 10 | 1.00 | 1.00 | 0.77 | 0.91 |
| Position of intersection between la(t) and lc(t) | | 40 | 46 | 26 | None |
| lc(t)/l(t) | t = 0 | 0.03 | 0.02 | 0.17 | 0.07 |
| | t = 30 | 0.03 | 0.03 | 0.32 | 0.16 |
| ls(t)/l(t) | t = 30 | 0.00 | 0.00 | 0.36 | 0.24 |
| | t = 60 | 0.00 | 0.00 | 0.59 | 0.33 |

In the table, "C." denotes "comparative".

Relating to formulae (1) and (5), each value of Ia(t) and Ic(t) within the range of $0 \leq t \leq 10$ in the examples and comparative examples was a value contained within the range of values between t=0 and t=10.

Relating to formula (2), each value of (Ia(t)+Ic(t))/I(t) within the range of $0 \leq t \leq 10$ in the examples and comparative examples was a value contained within the range of values between t=0 and t=10.

Relating to formula (6), each value of Ic(t) and Is(t) within the range of $0 \leq t \leq 30$ in the examples and comparative examples was a value contained within the range of values between t=0 and t=30.

Relating to formula (7), each value of Is(t)/I(t) within the range of $30 < t \leq 60$ in the examples and comparative examples was a value contained within the range of values between t=30 and t=60.

Example 1

Low Temperature Fixability

A laser beam printer, HP LaserJet Enterprise 600 M603 (Hewlett-Packard Company) was prepared with the fixing unit removed to evaluate low temperature fixability. The removed fixing unit was modified so that the temperature could be set at will and so that the process speed was 440 mm/sec.

Using this printer in a normal-temperature, normal-humidity environment (23.5° C., 60% RH), an unfixed image was prepared with a toner laid-on level of 0.5 mg/cm$^2$ per unit area. Next, this unfixed image was passed through the above fixing unit, which had been adjusted to 160° C. "Plover Bond Paper" (105 g/m$^2$, Fox River) was used as the recording medium. The resulting fixed image was rubbed 5 times back and forth under 4.9 kPa (50 g/cm$^2$) of load with Silbon paper, and the image density decrease rate (%) after rubbing was evaluated.

A: Image density decrease rate less than 5.0%

B: Image density decrease rate from 5.0% to less than 10.0%

C: Image density decrease rate from 10.0% to less than 15.0%

D: Image density decrease rate at least 15.0%

The results are shown in Table 5.

Fogging

A LaserJet Enterprise 600 M603 was used. 100,000 sheets were printed out with this printer in a normal-temperature, normal-humidity environment (23.5° C., 60% RH). Then, a sheet with an image having a white background was printed out. The reflectivity of the resulting images was measured with a reflection densitometer (Reflectometer Model TC-6DS, Tokyo Denshoku Co., Ltd.). A green filter was used as the filter for measurement.

Given Ds (%) as the minimum value of the white background reflectivity and Dr (%) as the reflectivity of the transfer material before image formation, Dr-Ds is given as the fogging value, and evaluated according to the following standard.

A: Fogging less than 1%

B: Fogging from 1% to less than 3%

C: Fogging from 3% to less than 5%

D: Fogging at least 5%

The results are shown in Table 5.

Heat Resistant Storability 10 g of toner was measured into a 50 mL plastic cup, and left standing for 3 days in a thermostatic tank at 55° C. After standing, the toner was observed visually, and the blocking properties were evaluated by the following standard. A grade of C or better is considered good.

A: Toner breaks up immediately when cup is swirled.

B: Some lumps present but shrink and break up when cup is swirled.

C: Lumps remain even when cup is swirled.

D: Large lumps that do not break up when cup is swirled.

The results are shown in Table 5.

Image Peeling

Using a LaserJet Enterprise 600 M603, 10 sheets of an image were output in a low-temperature, low-humidity environment (15.0° C., 10% RH). A 50 mm-square solid image was formed in the center of the transfer paper as the image. The images were folded in the middle 20 times consecutively in the same environment, and the degree of image peeling of the solid image was evaluated visually.

The evaluation standard was as follows.

A: No image peeling confirmed.

B: Slight image peeling observed at folded part.

C: Image peeling observed at folded part, but not a problem for practical use.

D: Image peeling also observed away from folded part.

The results are shown in Table 5.

Hot Offset Resistance

A laser beam printer, HP LaserJet Enterprise 600 M603 (Hewlett-Packard Company) was prepared with the fixing unit removed for evaluating hot offset resistance. The removed fixing unit was modified so that the temperature could be set at will and so that the process speed was 440 mm/sec.

Using this printer in a normal-temperature, normal-humidity environment (23.5° C., 60% RH), an unfixed image was prepared with a toner laid-on level of 0.5 mg/cm$^2$ per unit area. The set temperature was then raised in increments of 5° C. from an initial temperature of 100° C. as the unfixed image was fixed at each temperature. Hot offset resistance was then evaluated according to the standard below.

The low temperature fixing initiation point is the lowest temperature at which no phenomenon of cold offset (part of toner adhering to fixing unit) is observed.

A: The highest temperature at which no hot offset occurs is at least 50° C. higher than the temperature at the low temperature fixing initiation point.

B: The highest temperature at which no hot offset occurs is 40° C. or 45° C. higher than the temperature at the low temperature fixing initiation point.

C: The highest temperature at which no hot offset occurs is 30° C. or 35° C. higher than the temperature at the low temperature fixing initiation point.

D: The highest temperature at which no hot offset occurs is not more than 25° C. higher than the temperature at the low temperature fixing initiation point.

The results are shown in Table 5.

Examples 2 to 18, Comparative Examples 1 to 10

The toners shown in Tables 4-1, 4-2 and 4-3 were evaluated as in the Example 1. The results are shown in Table 5.

TABLE 5

| | Examples | | | | | |
|---|---|---|---|---|---|---|
| | 1 | 2 | 3 | 4 | 5 | 6 |
| Toner No. | 1 | 2 | 3 | 4 | 5 | 6 |
| Low temperature fixability (%) | A(3.5) | A(2.6) | A(2.7) | A(3.0) | B(5.1) | A(2.5) |
| Fogging (%) | A(0.7) | B(2.8) | A(0.9) | A(0.6) | A(0.5) | A(0.9) |
| Heat-resistant storability | A | B | B | A | B | B |
| Image peeling | A | A | A | A | C | B |
| Hot offset resistance (° C.) | A(55) | C(35) | B(40) | A(50) | A(55) | B(40) |

| | Examples | | | | | |
|---|---|---|---|---|---|---|
| | 7 | 8 | 9 | 10 | 11 | 12 |
| Toner No. | 7 | 8 | 9 | 10 | 11 | 12 |
| Low temperature fixability (%) | A(3.1) | A(4.0) | B(6.1) | A(3.9) | A(3.4) | B(6.9) |
| Fogging (%) | A(0.7) | A(0.7) | A(0.5) | C(3.3) | A(0.7) | A(0.5) |
| Heat-resistant storability | A | A | B | B | B | B |
| Image peeling | B | A | A | B | C | B |
| Hot offset resistance (° C.) | A(50) | A(55) | B(45) | B(45) | B(40) | B(40) |

| | Examples | | | | | |
|---|---|---|---|---|---|---|
| | 13 | 14 | 15 | 16 | 17 | 18 |
| Toner No. | 13 | 14 | 15 | 16 | 17 | 18 |
| Low temperature fixability (%) | B(7.2) | A(4.1) | B(8.1) | A(3.1) | C(12.2) | B(7.6) |
| Fogging (%) | A(0.5) | A(0.7) | A(0.5) | A(0.8) | B(2.1) | A(0.8) |
| Heat-resistant storability | A | A | A | A | A | B |
| Image peeling | B | B | B | B | B | B |
| Hot offset resistance (° C.) | B(45) | A(50) | A(50) | C(30) | B(45) | A(50) |

| | Comparative Examples | | | | | |
|---|---|---|---|---|---|---|
| | 1 | 2 | 3 | 4 | 5 | 6 |
| Toner No. | C. 1 | C. 2 | C. 3 | C. 4 | C. 5 | C. 6 |
| Low temperature fixability (%) | A(3.5) | D(15.1) | A(2.5) | C(13.1) | A(3.3) | D(15.5) |
| Fogging (%) | D(6.8) | A(0.7) | D(10.3) | D(7.2) | D(5.8) | A(0.5) |
| Heat-resistant storability | D | A | D | D | D | A |
| Image peeling | B | C | D | B | B | C |
| Hot offset resistance (° C.) | A(55) | B(45) | C(35) | D(20) | B(40) | A(50) |

| | Comparative Examples | | | |
|---|---|---|---|---|
| | 7 | 8 | 9 | 10 |
| Toner No. | C. 7 | C. 8 | C. 9 | C. 10 |
| Low temperature fixability (%) | D(16.3) | D(17.2) | D(16.1) | D(15.8) |
| Fogging (%) | A(0.6) | A(0.5) | B(2.5) | A(0.8) |
| Heat-resistant storability | A | A | B | A |
| Image peeling | B | C | C | C |
| Hot offset resistance (° C.) | C(30) | D(25) | B(40) | C(30) |

In the Table, "C." denotes "comparative".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-091356, filed May 14, 2019, which is hereby incorporated by reference herein in its entirety.

What is claimed is:

1. A toner comprising a toner particle that contains a resin component, wherein the resin component contains an amorphous polyester and a crystalline polyester, and in depth profile measurement of secondary ions on the toner particle surface by time-of-flight secondary ion mass spectrometry TOF-SIMS, given Ia(t) as the intensity of secondary ions derived from the amorphous polyester, Ic(t) as the intensity of secondary ions derived from the crystalline polyester, and I(t) as the total detected intensity of secondary ions derived from resin contained in the toner particle at a depth of t (nm) from the toner particle surface, the following formulae (1) and (2) are satisfied within the range of $0 \leq t \leq 10$:

$$Ia(t) > Ic(t) > 0.0000 \quad (1)$$

$$(Ia(t)+Ic(t))/I(t) \geq 0.80 \quad (2)$$

and there is only one point of intersection between the depth profile curve of Ia(t) and the depth profile curve of Ic(t) within the range of $10 < t \leq 30$.

2. The toner according to claim 1, wherein in depth profile measurement of secondary ions on the toner particle surface, given Ic(0) as the intensity of secondary ions derived from the crystalline polyester at t=0 and I(0) as the total detected intensity of secondary ions derived from resin contained in the toner particle at t=0, the following formula (3) is satisfied:

$$0.10 \leq Ic(0)/I(0) \leq 0.40 \quad (3).$$

3. The toner according to claim 1, wherein in depth profile measurement of secondary ions on the toner particle surface, given Ic(30) as the intensity of the secondary ions derived from the crystalline polyester at t=30 and I(30) as the total detected intensity of secondary ions derived from resin contained in the toner particle at t=30, the following formula (4) is satisfied:

$$0.40 < Ic(30)/I(30) \leq 0.90 \quad (4).$$

4. The toner according to claim 1, wherein Ic(t) satisfies the following formula (5) within the range of 0≤t≤10:

$$0.0100 \leq Ic(t) \leq 0.0350 \quad (5).$$

5. The toner according to claim 1, wherein the resin component contains a styrene acrylic resin.

6. The toner according to claim 5, wherein the content ratio of the styrene acrylic resin in the resin component is from 50 mass % to 99 mass %.

7. The toner according to claim 5, wherein in depth profile measurement of secondary ions on the toner particle surface by time-of-flight secondary ion mass spectrometry TOF-SIMS, given Is(t) as the intensity of the secondary ions derived from the styrene acrylic resin at a depth of t (nm) from the toner particle surface, formula (6) below is satisfied within the range of 0≤t≤30:

$$Ic(t) > Is(t) \quad (6).$$

8. The toner according to claim 5, wherein in depth profile measurement of secondary ions on the toner particle surface by time-of-flight secondary ion mass spectrometry TOF-SIMS, given Is(t) as the intensity of the secondary ions derived from the styrene acrylic resin at a depth of t (nm) from the toner particle surface, formula (7) below is satisfied within the range of 30<t≤60:

$$0.10 \leq Is(t)/I(t) \leq 0.50 \quad (7).$$

9. The toner according to claim 1, wherein given SP1 $(cal/cm^3)^{1/2}$ as the SP value of the crystalline polyester and SP2 $(cal/cm^3)^{1/2}$ as the SP value of the amorphous polyester, SP2-SP1 is from 3.00 to 3.70.

10. The toner according to claim 1, wherein the SP value $(cal/cm^3)^{1/2}$ of the amorphous polyester is from 12.40 to 12.90.

11. The toner according to claim 1, wherein the amorphous polyester is a condensation polymer of a dicarboxylic acid component and a dialcohol component containing a bisphenol A alkylene oxide adduct with an average of from 3.0 to 5.0 added moles of an alkylene oxide, and the alkylene oxide is selected from ethylene oxide and propylene oxide.

12. The toner according to claim 1, wherein the weight-average molecular weight of the crystalline polyester is from 3000 to 50000.

13. The toner according to claim 1, wherein the weight-average particle diameter D4 of the toner particle is from 4.00 μm to 15.00 μm.

14. The toner according to claim 1, wherein the crystalline polyester is a condensation polymer of monomers include a linear aliphatic dicarboxylic acid and a linear aliphatic diol.

15. The toner according to claim 1, wherein the toner particle is a suspension polymerized toner particle.

* * * * *